US012509273B2

(12) United States Patent
Lin et al.

(10) Patent No.: US 12,509,273 B2
(45) Date of Patent: Dec. 30, 2025

(54) PACKAGING FOR A PATIENT INTERFACE

(71) Applicant: RESMED ASIA PTE. LTD., Singapore (SG)

(72) Inventors: Han Cheng Lin, Singapore (SG); Jing Chen, Singapore (SG); Sipu Chen, Singapore (SG)

(73) Assignee: ResMed Asia Pte. Ltd., Singapore (SG)

( * ) Notice: Subject to any disclaimer, the term of this patent is extended or adjusted under 35 U.S.C. 154(b) by 74 days.

(21) Appl. No.: 18/568,223

(22) PCT Filed: Jun. 30, 2022

(86) PCT No.: PCT/SG2022/050455
§ 371 (c)(1),
(2) Date: Dec. 7, 2023

(87) PCT Pub. No.: WO2023/277818
PCT Pub. Date: Jan. 5, 2023

(65) Prior Publication Data

US 2025/0121977 A1 Apr. 17, 2025

(30) Foreign Application Priority Data

Jun. 30, 2021 (SG) ..... 10202107191X
Jan. 17, 2022 (SG) ..... 10202200444Y

(51) Int. Cl.
*B65D 5/24* (2006.01)
*B65D 5/50* (2006.01)
(Continued)

(52) U.S. Cl.
CPC ..... *B65D 5/241* (2013.01); *B65D 5/5028* (2013.01); *B65D 5/6667* (2013.01); *B65D 85/68* (2013.01); *B65D 2203/02* (2013.01)

(58) Field of Classification Search
CPC ..... A61M 16/06; A61M 16/08; A62B 25/00; B65D 1/36; B65D 5/20; B65D 5/241;
(Continued)

(56) References Cited

U.S. PATENT DOCUMENTS 4,782,832 A 11/1988 Trimble et al.
4,944,310 A 7/1990 Sullivan
(Continued)

FOREIGN PATENT DOCUMENTS

WO WO 98/004310 A1 2/1998
WO WO 98/034665 A1 8/1998
(Continued)

OTHER PUBLICATIONS

"*Respiratory Physiology*", by John B. West, Lippincott Williams & Wilkins, 9th edition published 2012 (8 pages).
(Continued)

*Primary Examiner* — Bryon P Gehman
(74) *Attorney, Agent, or Firm* — Nixon & Vanderhye P.C.

(57) ABSTRACT

Packaging for a patient interface comprises: a plurality of panels arranged to be folded inwardly to define a housing for the patient interface, the plurality of panels comprising a pair of opposed side panels and a pair of opposed end panels; and a panel-retaining structure that is arranged to prevent outward collapse of the panels such that the patient interface is held in a compressed state; wherein at least one of the panels comprises at least one patient interface retaining feature that is attachable to the patient interface; and wherein the panel-retaining structure is releasable to cause the patient interface in the compressed state to urge one or more of the panels outwardly, to thereby enable display of the patient interface in a substantially in-use configuration.

23 Claims, 19 Drawing Sheets

(51) Int. Cl.
*B65D 5/66* (2006.01)
*B65D 85/68* (2006.01)

(58) Field of Classification Search
CPC ..... B65D 5/502; B65D 5/6667; B65D 25/04; B65D 25/10; B65D 33/00; B65D 77/00; B65D 85/00; B65D 85/18; B65D 85/68; B65D 5/5028; B65D 2203/02
USPC ..... 206/438
See application file for complete search history.

(56) References Cited

U.S. PATENT DOCUMENTS

| | | | | |
|---|---|---|---|---|
| 5,687,715 | A | 11/1997 | Landis | |
| 6,532,959 | B1 | 3/2003 | Berthon-Jones | |
| 6,581,594 | B1 | 6/2003 | Drew et al. | |
| 7,743,920 | B1 * | 6/2010 | Lordo | B65D 33/004 206/278 |
| 7,866,944 | B2 | 1/2011 | Kenyon et al. | |
| 7,931,144 | B2 * | 4/2011 | Lordo | B65D 33/004 206/278 |
| 8,636,479 | B2 | 1/2014 | Kenyon et al. | |
| 8,638,014 | B2 | 1/2014 | Sears et al. | |
| 8,733,349 | B2 | 5/2014 | Bath et al. | |
| 11,884,469 | B2 * | 1/2024 | Hammer | B65D 25/10 |
| 2009/0044808 | A1 | 2/2009 | Guney et al. | |
| 2009/0050156 | A1 | 2/2009 | Ng et al. | |
| 2010/0000534 | A1 | 1/2010 | Kooij et al. | |
| 2010/0230314 | A1 | 9/2010 | Lordo | |
| 2015/0122685 | A1 | 5/2015 | Wakeham et al. | |
| 2020/0108989 | A1 | 4/2020 | Hammer et al. | |

FOREIGN PATENT DOCUMENTS

| | | | |
|---|---|---|---|
| WO | WO 2000/078381 | A1 | 12/2000 |
| WO | WO 2004/073778 | A1 | 9/2004 |
| WO | WO 2005/063328 | A1 | 7/2005 |
| WO | WO 2006/074513 | A1 | 7/2006 |
| WO | WO 2006/130903 | A1 | 12/2006 |
| WO | WO 2009/052560 | A1 | 4/2009 |
| WO | WO 2010/135785 | A1 | 12/2010 |
| WO | WO 2012/171072 | A1 | 12/2012 |
| WO | WO 2013/020167 | A1 | 2/2013 |

OTHER PUBLICATIONS

International Search Report and Written Opinion for PCT/SG2022/050455 mailed Feb. 20, 2023, 15 pages.

* cited by examiner

PACKAGING FOR A PATIENT INTERFACE

1 CROSS-REFERENCE TO RELATED APPLICATIONS

This application is the U.S. national phase of International Application No. PCT/SG2022/050455 filed Jun. 30, 2022, which designated the U.S. and claims the benefit of Singapore patent application Ser. No. 10/202,200444Y, filed Jan. 17, 2022 and Singapore patent application Ser. No. 10/202,107191X, filed Jun. 30, 2021, the entire contents of each of which are hereby incorporated herein by reference in their entirety.

2 BACKGROUND OF THE TECHNOLOGY

2.1 Field of the Technology

The present technology relates to one or more of the screening, diagnosis, monitoring, treatment, prevention and amelioration of respiratory-related disorders. The present technology also relates to medical devices or apparatus, and their use.

2.2 Description of the Related Art 2.2.1 Human Respiratory System and its Disorders The respiratory system of the body facilitates gas exchange. The nose and mouth form the entrance to the airways of a patient.

The airways include a series of branching tubes, which become narrower, shorter and more numerous as they penetrate deeper into the lung. The prime function of the lung is gas exchange, allowing oxygen to move from the inhaled air into the venous blood and carbon dioxide to move in the opposite direction. The trachea divides into right and left main bronchi, which further divide eventually into terminal bronchioles. The bronchi make up the conducting airways, and do not take part in gas exchange. Further divisions of the airways lead to the respiratory bronchioles, and eventually to the alveoli. The alveolated region of the lung is where the gas exchange takes place, and is referred to as the respiratory zone. See "Respiratory Physiology", by John B. West, Lippincott Williams & Wilkins, 9th edition published 2012.

A range of respiratory disorders exist. Certain disorders may be characterised by particular events, e.g. apneas, hypopneas, and hyperpneas.

Examples of respiratory disorders include Obstructive Sleep Apnea (OSA), Cheyne-Stokes Respiration (CSR), respiratory insufficiency, Obesity Hyperventilation Syndrome (OHS), Chronic Obstructive Pulmonary Disease (COPD), Neuromuscular Disease (NMD) and Chest wall disorders.

A range of therapies have been used to treat or ameliorate such conditions. Furthermore, otherwise healthy individuals may take advantage of such therapies to prevent respiratory disorders from arising. However, these have a number of shortcomings.

2.2.2 Therapies

Various respiratory therapies, such as Continuous Positive Airway Pressure (CPAP) therapy, Non-invasive ventilation (NIV), Invasive ventilation (IV), and High Flow Therapy (HFT) have been used to treat one or more of the above respiratory disorders.

2.2.2.1 Respiratory Pressure Therapies

Respiratory pressure therapy is the application of a supply of air to an entrance to the airways at a controlled target pressure that is nominally positive with respect to atmosphere throughout the patient's breathing cycle (in contrast to negative pressure therapies such as the tank ventilator or cuirass).

2.2.3 Respiratory Therapy Systems

These respiratory therapies may be provided by a respiratory therapy system or device. Such systems and devices may also be used to screen, diagnose, or monitor a condition without treating it.

A respiratory therapy system may comprise a Respiratory Pressure Therapy Device (RPT device), an air circuit, a humidifier, a patient interface, an oxygen source, and data management.

2.2.3.1 Patient Interface

A patient interface may be used to interface respiratory equipment to its wearer, for example by providing a flow of air to an entrance to the airways. The flow of air may be provided via a mask to the nose and/or mouth, a tube to the mouth or a tracheostomy tube to the trachea of a patient. Depending upon the therapy to be applied, the patient interface may form a seal, e.g., with a region of the patient's face, to facilitate the delivery of gas at a pressure at sufficient variance with ambient pressure to effect therapy, e.g., at a positive pressure of about 10 $cmH_2O$ relative to ambient pressure. For other forms of therapy, such as the delivery of oxygen, the patient interface may not include a seal sufficient to facilitate delivery to the airways of a supply of gas at a positive pressure of about 10 $cmH_2O$. For flow therapies such as nasal HFT, the patient interface is configured to insufflate the nares but specifically to avoid a complete seal. One example of such a patient interface is a nasal cannula.

The design of a patient interface presents a number of challenges. The face has a complex three-dimensional shape. The size and shape of noses and heads varies considerably between individuals. Since the head includes bone, cartilage and soft tissue, different regions of the face respond differently to mechanical forces. The jaw or mandible may move relative to other bones of the skull. The whole head may move during the course of a period of respiratory therapy.

As a consequence of these challenges, some masks suffer from being one or more of obtrusive, aesthetically undesirable, costly, poorly fitting, difficult to use, and uncomfortable especially when worn for long periods of time or when a patient is unfamiliar with a system. Wrongly sized masks can give rise to reduced compliance, reduced comfort and poorer patient outcomes. Masks designed solely for aviators, masks designed as part of personal protection equipment (e.g. filter masks), SCUBA masks, or for the administration of anaesthetics may be tolerable for their original application, but nevertheless such masks may be undesirably uncomfortable to be worn for extended periods of time, e.g., several hours. This discomfort may lead to a reduction in patient compliance with therapy. This is even more so if the mask is to be worn during sleep.

CPAP therapy is highly effective to treat certain respiratory disorders, provided patients comply with therapy. If a mask is uncomfortable, or difficult to use a patient may not comply with therapy. Since it is often recommended that a patient regularly wash their mask, if a mask is difficult to clean (e.g., difficult to assemble or disassemble), patients may not clean their mask and this may impact on patient compliance.

2.2.3.1.1 Seal-Forming Structure

Patient interfaces may include a seal-forming structure. Since it is in direct contact with the patient's face, the shape and configuration of the seal-forming structure can have a direct impact the effectiveness and comfort of the patient interface.

A patient interface may be partly characterised according to the design intent of where the seal-forming structure is to engage with the face in use. In one form of patient interface, a seal-forming structure may comprise a first sub-portion to form a seal around the left naris and a second sub-portion to form a seal around the right naris. In one form of patient interface, a seal-forming structure may comprise a single element that surrounds both nares in use. Such single element may be designed to for example overlay an upper lip region and a nasal bridge region of a face. In one form of patient interface a seal-forming structure may comprise an element that surrounds a mouth region in use, e.g. by forming a seal on a lower lip region of a face. In one form of patient interface, a seal-forming structure may comprise a single element that surrounds both nares and a mouth region in use. These different types of patient interfaces may be known by a variety of names by their manufacturer including nasal masks, full-face masks, nasal pillows, nasal puffs and oro-nasal masks.

A seal-forming structure that may be effective in one region of a patient's face may be inappropriate in another region, e.g. because of the different shape, structure, variability and sensitivity regions of the patient's face. For example, a seal on swimming goggles that overlays a patient's forehead may not be appropriate to use on a patient's nose.

Certain seal-forming structures may be designed for mass manufacture such that one design fit and be comfortable and effective for a wide range of different face shapes and sizes. To the extent to which there is a mismatch between the shape of the patient's face, and the seal-forming structure of the mass-manufactured patient interface, one or both must adapt in order for a seal to form.

One type of seal-forming structure extends around the periphery of the patient interface, and is intended to seal against the patient's face when force is applied to the patient interface with the seal-forming structure in confronting engagement with the patient's face. The seal-forming structure may include an air or fluid filled cushion, or a moulded or formed surface of a resilient seal element made of an elastomer such as a rubber. With this type of seal-forming structure, if the fit is not adequate, there will be gaps between the seal-forming structure and the face, and additional force will be required to force the patient interface against the face in order to achieve a seal.

Another type of seal-forming structure incorporates a flap seal of thin material positioned about the periphery of the mask so as to provide a self-sealing action against the face of the patient when positive pressure is applied within the mask. Like the previous style of seal forming portion, if the match between the face and the mask is not good, additional force may be required to achieve a seal, or the mask may leak. Furthermore, if the shape of the seal-forming structure does not match that of the patient, it may crease or buckle in use, giving rise to leaks.

Another type of seal-forming structure may comprise a friction-fit element, e.g. for insertion into a naris, however some patients find these uncomfortable.

Another form of seal-forming structure may use adhesive to achieve a seal. Some patients may find it inconvenient to constantly apply and remove an adhesive to their face.

A range of patient interface seal-forming structure technologies are disclosed in the following patent applications, assigned to ResMed Limited: WO 1998/004,310; WO 2006/074,513; WO 2010/135,785.

One form of nasal pillow is found in the Adam Circuit manufactured by Puritan Bennett. Another nasal pillow, or nasal puff is the subject of U.S. Pat. No. 4,782,832 (Trimble et al.), assigned to Puritan-Bennett Corporation.

ResMed Limited has manufactured the following products that incorporate nasal pillows: SWIFT™ nasal pillows mask, SWIFT™ II nasal pillows mask, SWIFT™ LT nasal pillows mask, SWIFT™ FX nasal pillows mask and MIRAGE LIBERTY™ full-face mask. The following patent applications, assigned to ResMed Limited, describe examples of nasal pillows masks: International Patent Application WO2004/073,778 (describing amongst other things aspects of the ResMed Limited SWIFT™ nasal pillows), US Patent Application 2009/0044808 (describing amongst other things aspects of the ResMed Limited SWIFT™ LT nasal pillows); International Patent Applications WO 2005/063,328 and WO 2006/130,903 (describing amongst other things aspects of the ResMed Limited MIRAGE LIBERTY™ full-face mask); International Patent Application WO 2009/052,560 (describing amongst other things aspects of the ResMed Limited SWIFT™ FX nasal pillows).

2.2.3.1.2 Positioning and Stabilising

A seal-forming structure of a patient interface used for positive air pressure therapy is subject to the corresponding force of the air pressure to disrupt a seal. Thus a variety of techniques have been used to position the seal-forming structure, and to maintain it in sealing relation with the appropriate portion of the face.

One technique is the use of adhesives. See for example US Patent Application Publication No. US 2010/0000534. However, the use of adhesives may be uncomfortable for some.

Another technique is the use of one or more straps and/or stabilising harnesses. Many such harnesses suffer from being one or more of ill-fitting, bulky, uncomfortable and awkward to use.

Positioning and stabilising structures for patient interfaces may be somewhat complicated in design, due to (among other things) some of the challenges mentioned above. A user of a patient interface may have difficulty in understanding how to correctly set up and wear the patient interface without assistance from an expert such as a clinician. Accordingly, there remains a need for a way to facilitate setup and use of patient interfaces.

2.2.3.2 Respiratory Pressure Therapy (RPT) Device

A respiratory pressure therapy (RPT) device may be used individually or as part of a system to deliver one or more of a number of therapies described above, such as by operating the device to generate a flow of air for delivery to an interface to the airways. The flow of air may be pressure-controlled (for respiratory pressure therapies) or flow-controlled (for flow therapies such as HFT). Thus RPT devices may also act as flow therapy devices. Examples of RPT devices include a CPAP device and a ventilator.

2.2.3.3 Air Circuit

An air circuit is a conduit or a tube constructed and arranged to allow, in use, a flow of air to travel between two components of a respiratory therapy system such as the RPT device and the patient interface. In some cases, there may be separate limbs of the air circuit for inhalation and exhalation. In other cases, a single limb air circuit is used for both inhalation and exhalation.

3 BRIEF SUMMARY OF THE TECHNOLOGY

The present technology is directed towards providing medical devices used in the screening, diagnosis, monitoring, amelioration, treatment, or prevention of respiratory disorders having one or more of improved comfort, cost, efficacy, ease of use and manufacturability.

A first aspect of the present technology relates to apparatus used in the screening, diagnosis, monitoring, amelioration, treatment or prevention of a respiratory disorder.

Another aspect of the present technology relates to a patient interface for delivering pressurised breathable gas to a patient. The patient interface comprises a seal-forming structure for sealing around an entrance to the patient's airways. The patient interface also comprises a plenum chamber configured to receive a flow of pressurised breathable gas. The patient interface also comprises a positioning and stabilising structure configured to maintain the seal-forming structure in an operable position.

Another aspect of the present technology relates to methods used in the screening, diagnosis, monitoring, amelioration, treatment or prevention of a respiratory disorder.

An aspect of certain forms of the present technology is to provide methods and/or apparatus that improve the compliance of patients with respiratory therapy.

One form of the present technology comprises a packaging for a patient interface.

One form of the present technology comprises a foldable packaging with movable panels in order to form an opened and closed position.

One form of the present technology comprises panels of a housing including at least one retaining structure configured to retain a patient interface in a desired position.

One form of the present technology comprises a packaging having panels and a panel retaining structure. The panels are movable from an outwardly collapsed state to an in use state. The panel retaining structure selectively maintaining the positon of the panels in the in use state.

In some forms, the panel retaining structure may be disposed on one of the panels. For example, the panel retaining structure may be a fastener (e.g., a magnet, hook and loop material, a mechanical fastener, etc.) on one panel that removably connects to a fastener on another panel.

One form of the present technology comprises a packaging for a patient interface comprising a plurality of panels arranged to be folded inwardly to define a housing for the patient interface, the plurality of panels comprising a pair of opposed side panels and a pair of opposed end panels, and a panel-retaining structure that is arranged to prevent outward collapse of the panels such that the patient interface is held in a compressed state; wherein at least one of the panels comprises at least one patient interface retaining feature that is attachable to the patient interface; and wherein the panel-retaining structure is releasable to cause the patient interface in the compressed state to urge one or more of the panels outwardly, to thereby enable display of the patient interface in a substantially in-use configuration.

Another aspect of one form of the present technology is the at least one patient interface retaining feature comprises one or more of: a tie; a clip; a press stud; a strap; a hook and loop fastener; a button; and a magnet.

Another aspect of one form of the present technology is when the at least one patient interface retaining feature comprises a magnet, one of the end panels comprises at least two patient interface retaining features arranged to be magnetically attractable to each other.

Another aspect of one form of the present technology is the at least one patient interface retaining feature comprises a magnet for attracting to a magnet on the patient interface.

Another form of the present technology comprises a packaging comprising a plurality of panels arranged to move from an open position to a closed position that at least partially forms a volume for receiving the patient interface, the plurality of panels comprising a pair of opposed side panels and a pair of opposed end panels, wherein each of the plurality of panels are movable independently of the other panels of the plurality of panels; and a panel-retaining structure removably connected to at least one of the panels of the plurality of panels, the panel-retaining structure being arranged to prevent outward collapse of the panels in a connected position; at least one patient interface retaining feature connected to at least one of the panels of the plurality of panels, the at least one patient interface retaining feature configured to removably connect to the patient interface and retain the patient interface in a desired position; and wherein the plurality of panels are biased toward the open position and are configured to move toward the open position when the panel-retaining structure is released from the at least one panel of the plurality of panel.

In some forms, a) the at least one patient interface retaining feature comprises one or more of: a tie; a clip; a press stud; a strap; a hook and loop fastener; a button; and a magnet; b) the at least one patient interface retaining feature comprises a plurality of patient interface retaining features; and/or c) one patient interface retaining feature of the plurality of patient interface retaining features is connected to each panel of the plurality of panels.

In some forms, a) a pair of side flaps and an end flap extend from at least one end panel of the pair of opposed end panels; b) the pair of side flaps and the end flap are oriented substantially perpendicularly to the at least one end panel in the open position and in the closed position; c) each side flap of the pair of side flaps contacts one side panel of the pair of opposed side panels in the closed position; d) the at least one end panel is a pair of end panels and each end panel of the pair of end panels includes a pair of side flaps and an end flap; e) each side flap of the pair of side flaps of the pair of end panels contacts one side panel of the pair of opposed side panels in the closed position; f) the pair of side flaps of one of the least one end panel is spaced apart from the pair of side flaps of the other of the at least one end panel; g) a sleeve removably positioned around an exterior surface of the at least one end panel; h) the sleeve is configured to selectively retain the at least one end panel in the closed position; and/or i) the sleeve is in contact with the end flap.

In some forms, a) a hook is connected to a top panel of the extending from the at least one end panel; b) the hook is connected to the top panel as a cantilever structure; c) a bottom wall is configured to support the plurality of panels in an upright position; d) each panel of the plurality of panels is connected to the bottom wall via a hinge; and/or e) each panel of the plurality of panels is configured to pivotably move relatively to the bottom wall.

In some forms, a packaging system may include a patient interface and the packaging of any one of the previous forms.

Another form of the present technology comprises a storage system comprising a patient interface; and a packaging configured to selectively house the patient interface, the packaging comprising, a plurality of panels arranged to move from an open position to a closed position that at least partially forms a volume for receiving the patient interface, the plurality of panels comprising a pair of opposed side panels and a pair of opposed end panels, wherein each of the plurality of panels are movable independently of the other panels of the plurality of panels; at least one patient interface retaining feature connected to at least one of the panels of the plurality of panels, the at least one patient interface retaining feature configured to removably connect to the patient interface and retain the patient interface in a desired position, the at least one patient interface retaining feature comprising a male part and a female part configured to selectively connect to one another, wherein the patient interface retaining feature forming a loop when the male part and the female part are connected to one another, and wherein the loop is configured to wrap around a portion of the patient interface.

In some forms, a) the packaging further comprises a panel-retaining structure that is arranged to prevent outward collapse of the panels such that the patient interface is held in a compressed state; b) the panel-retaining structure comprises a lid having at least one flap arranged to engage an external surface of a first end panel of the pair of opposed end panels; c) the lid extends from, and/or comprises at least part of, a second end panel of the pair of opposed end panels; d) the lid has a hinge that is connected to, or is part of, the second end panel; and/or e) part of the second end panel forms a top wall of the lid.

In some forms, a) the panels are joined by a foldable web; b) the lid comprises first and second lid portions each comprising a pair of opposed side flaps arranged to engage with respective side panels; c) the panel-retaining structure comprises the opposed side flaps of the first and second lid portions; and/or d) each lid portion comprises a top wall extending transversely of its opposed side flaps and a respective one of the end panels.

In some forms, a) the at least one patient interface retaining feature comprises a strap; b) the strap is formed from a cut-out portion of a layer of material that is laminated to one of the panels; c) the strap includes a male part formed on one panel of the plurality of panels and a female part formed on another one of the plurality of panels adjacent to the one panel of the plurality of panels; d) the male part and the female part selectively form a mechanical connection between themselves in order to form the loop for retaining the patient interface; e) the male part includes an undercut selectively receivable within a groove of the female part; and/or f) the male part and the female part are selectively connected to one another using a magnetic force.

In some forms, a) the at least one patient interface retaining feature comprises a strap; b) the male part formed on either the strap or the at least one panel and the female part formed on the other of the strap or at least one panel; c) the male part and the female part comprises one or more of: a press stud; a hook and loop fastener; a button; and a magnet; d) one of the end panels comprises at least two patient interface retaining features arranged to attach to the patient interface on either side of a seal-forming structure of the patient interface, or at opposed ends of a posterior strap of a positioning and stabilising structure of the patient interface; and/or e) the at least one patient interface retaining feature comprises a magnet for attracting to a magnet on the patient interface.

Another aspect of one form of the present technology is a patient interface that is moulded or otherwise constructed with a perimeter shape which is complementary to that of an intended wearer.

An aspect of one form of the present technology is a method of manufacturing apparatus.

An aspect of certain forms of the present technology is a medical device that is easy to use, e.g. by a person who does not have medical training, by a person who has limited dexterity, vision or by a person with limited experience in using this type of medical device.

An aspect of one form of the present technology is a portable RPT device that may be carried by a person, e.g., around the home of the person.

An aspect of one form of the present technology is a patient interface that may be washed in a home of a patient, e.g., in soapy water, without requiring specialised cleaning equipment. An aspect of one form of the present technology is a humidifier tank that may be washed in a home of a patient, e.g., in soapy water, without requiring specialised cleaning equipment.

The methods, systems, devices and apparatus described may be implemented so as to improve the functionality of a processor, such as a processor of a specific purpose computer, respiratory monitor and/or a respiratory therapy apparatus. Moreover, the described methods, systems, devices and apparatus can provide improvements in the technological field of automated management, monitoring and/or treatment of respiratory conditions, including, for example, sleep disordered breathing.

Of course, portions of the aspects may form sub-aspects of the present technology. Also, various ones of the sub-aspects and/or aspects may be combined in various manners and also constitute additional aspects or sub-aspects of the present technology.

Other features of the technology will be apparent from consideration of the information contained in the following detailed description, abstract, drawings and claims.

4 BRIEF DESCRIPTION OF THE DRAWINGS

The present technology is illustrated by way of example, and not by way of limitation, in the figures of the accompanying drawings, in which like reference numerals refer to similar elements including:

4.1 Respiratory Therapy Systems

FIG. 1 shows a system including a patient 1000 wearing a patient interface 3000, in the form of a nasal mask, receiving a supply of air at positive pressure from an RPT device 4000. Air from the RPT device is humidified in a humidifier 5000, and passes along an air circuit 4170 to the patient 1000.

4.2 Patient Interface

4.3 Packaging for a Patient Interface

Figure 4A:
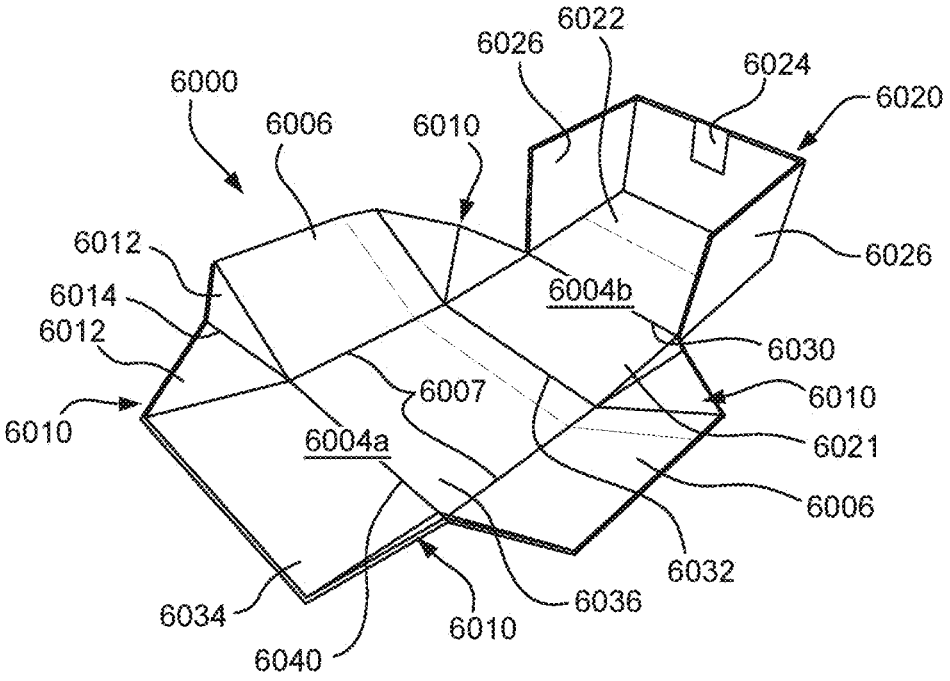

FIG. 4A shows packaging in an open configuration for a patient interface in accordance with one form of the present technology.

Figure 4B:
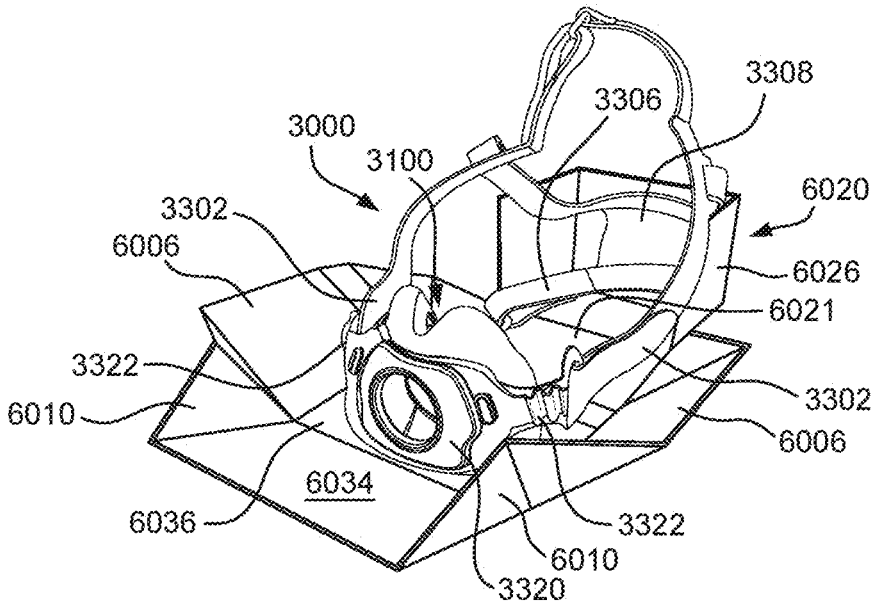

FIG. 4B shows the packaging with a patient interface as it is displayed when the packaging is opened.

Figure 4C:
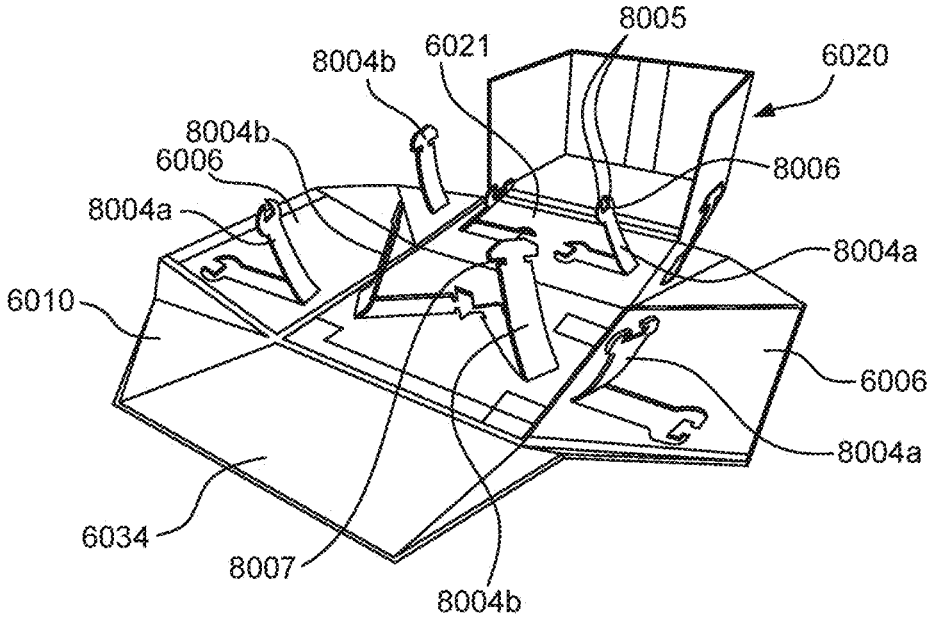

FIG. 4C shows the opened packaging with patient interface retaining features.

Figure 4D:
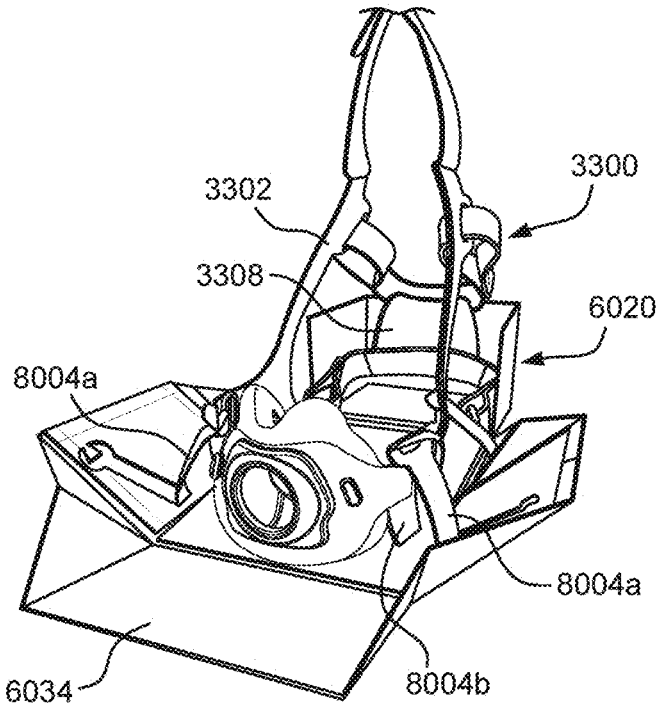

FIG. 4D shows the opened packaging with patient interface retaining features attached to the patient interface.

Figure 5A:
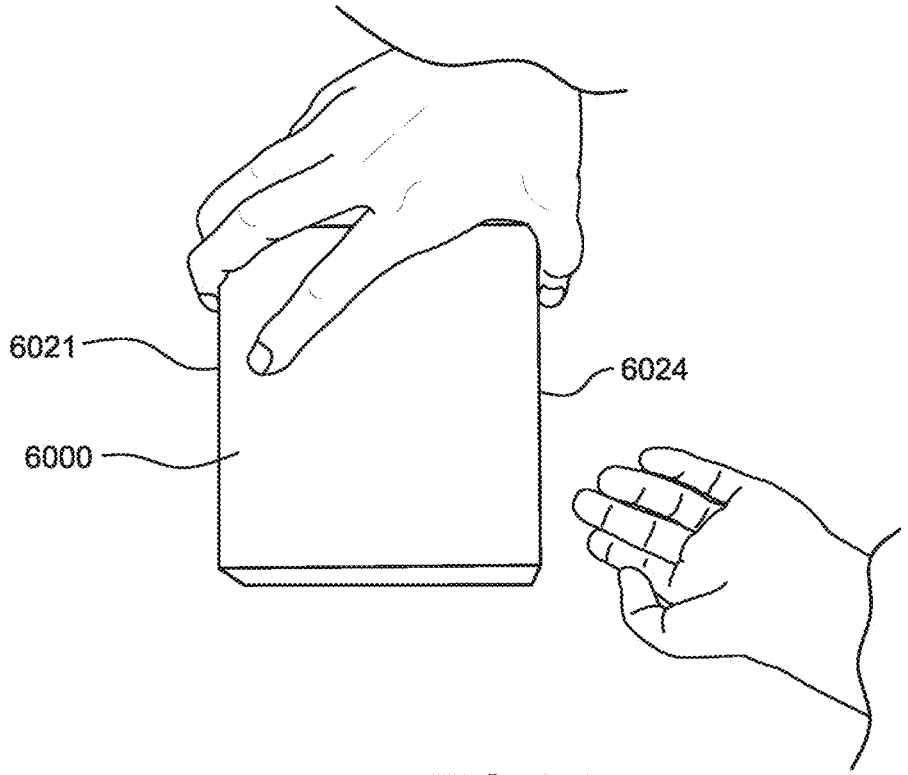

FIG. 5A shows a top view of the packaging of FIGS. 4A to 4D at the start of an opening sequence.

Figure 5B:
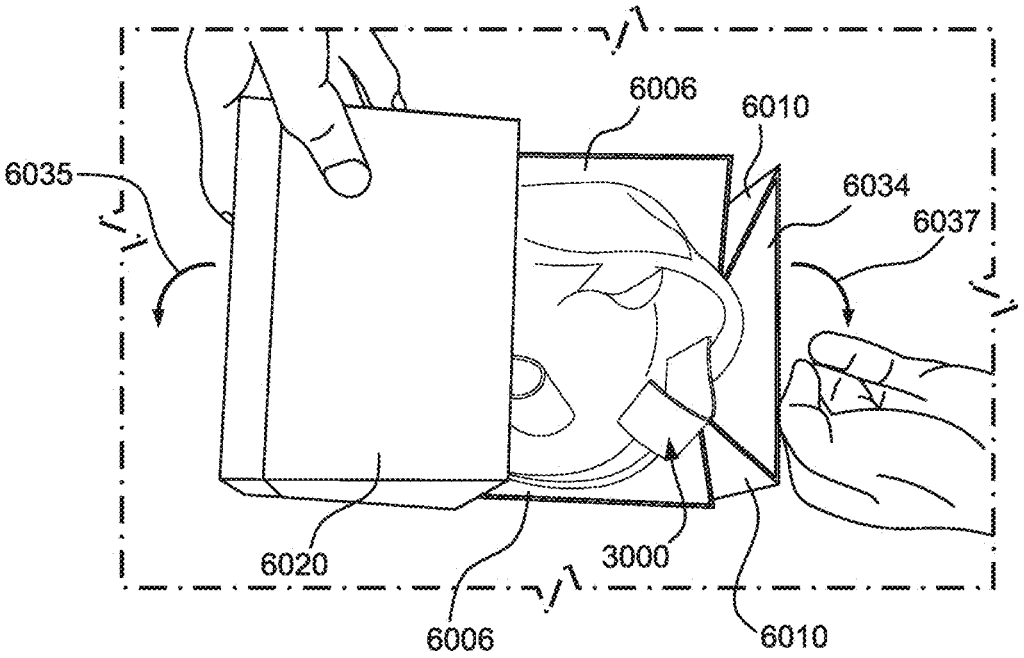

FIG. 5B shows a top view of the packaging mid-way through the opening sequence.

Figure 5C:
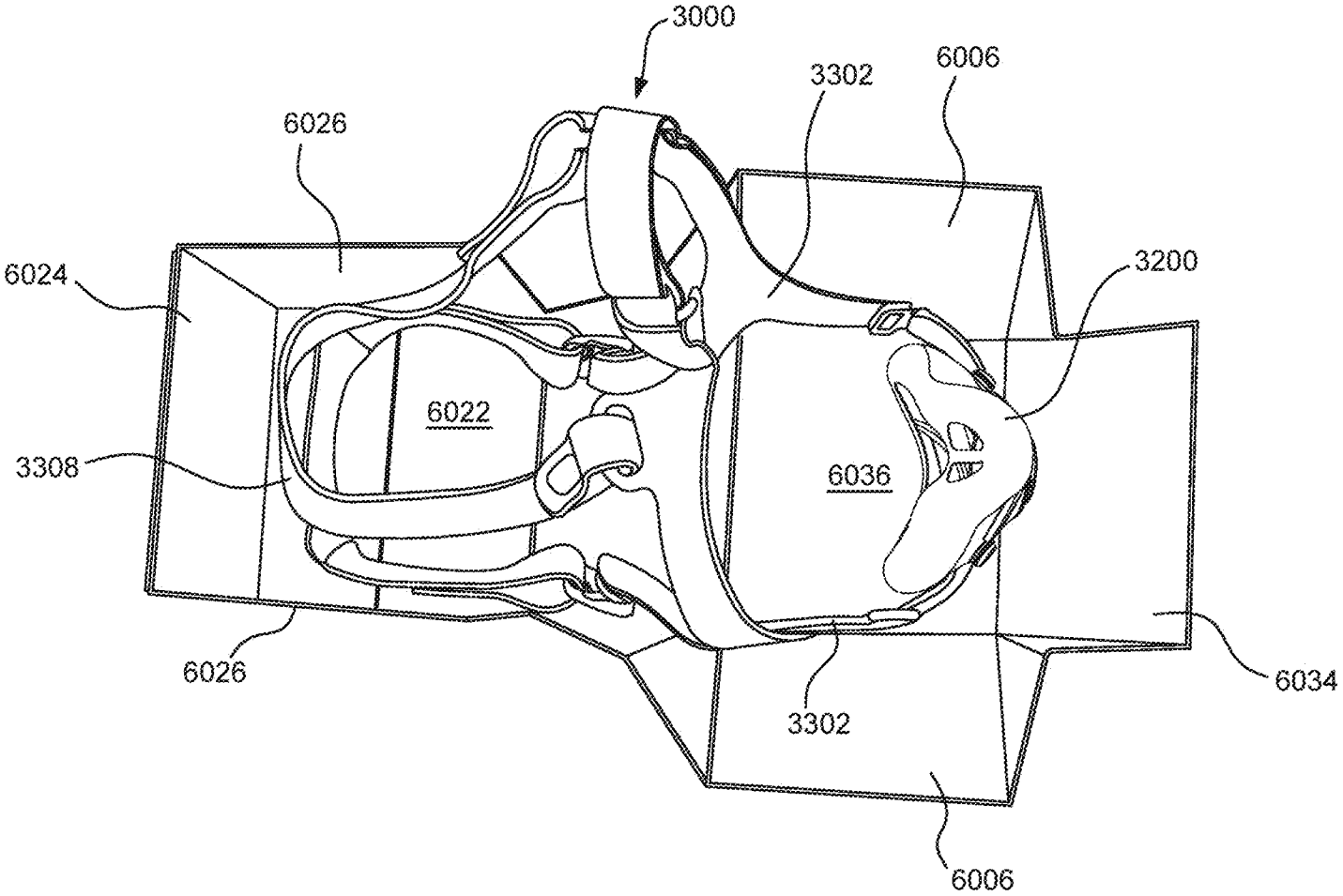

FIG. 5C shows a top view of the packaging at the end of the opening sequence.

Figure 6A:
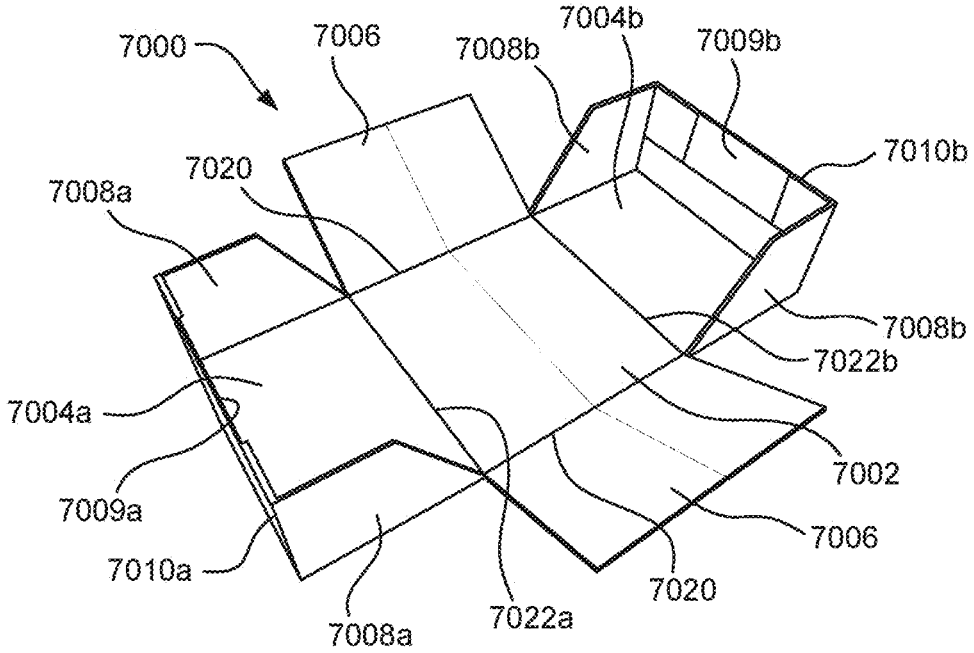

FIG. 6A shows packaging in an open configuration for a patient interface in accordance with another form of the present technology.

Figure 6B:
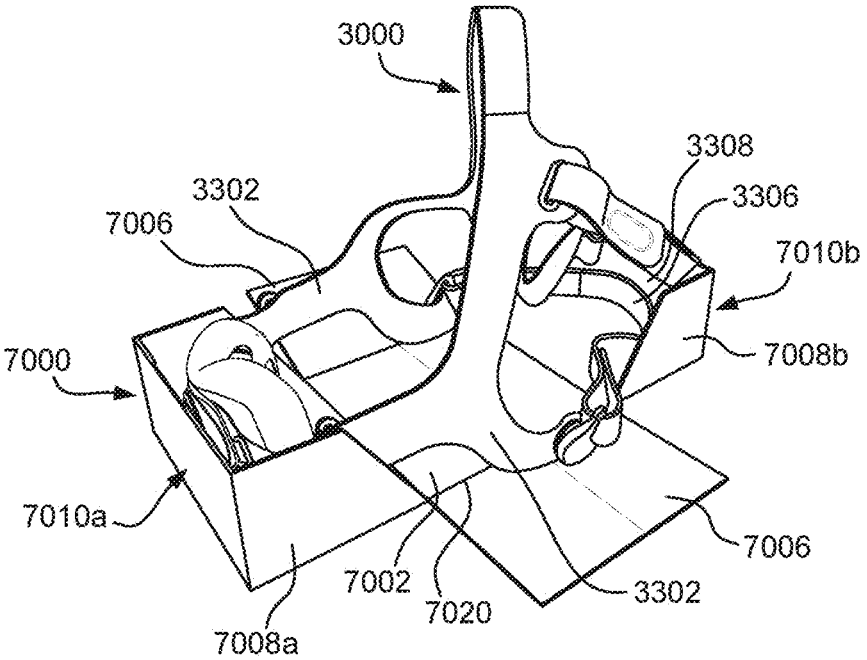

FIG. 6B shows the packaging of FIG. 6A with a patient interface as it is displayed when the packaging is opened.

Figure 6C:
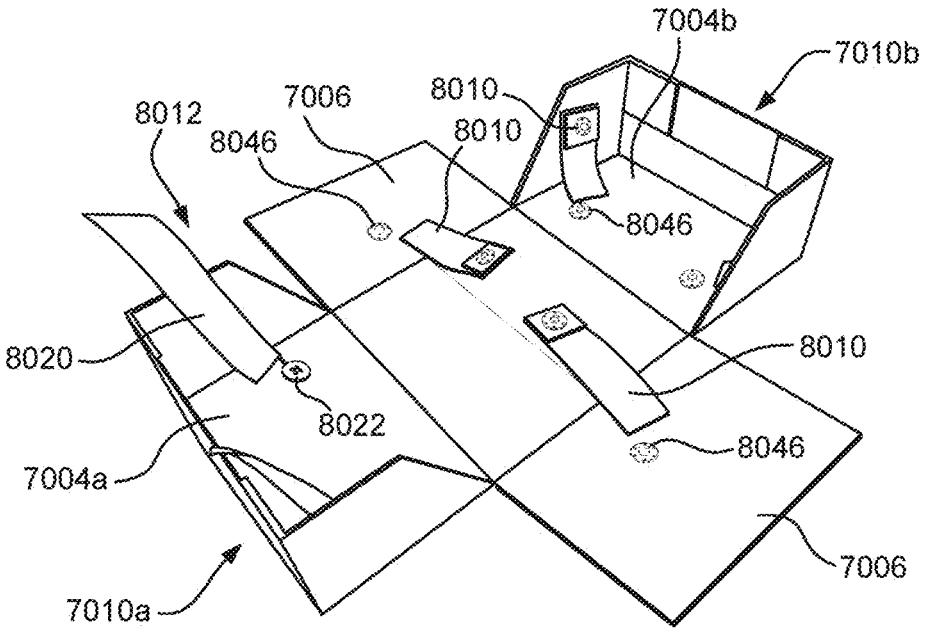

FIG. 6C shows the opened packaging of FIG. 6A with patient interface retaining features.

Figure 6D:
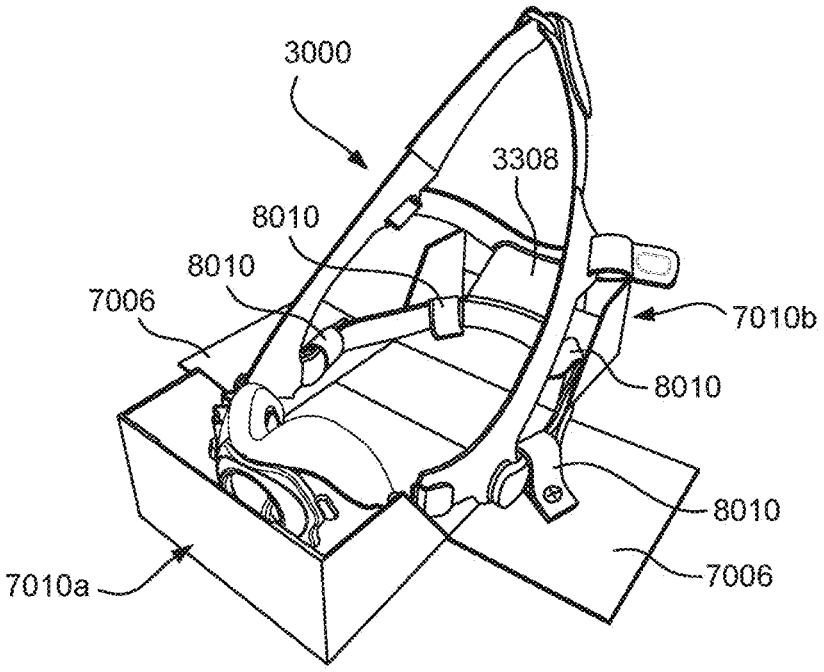

FIG. 6D shows the opened packaging of FIG. 6A with patient interface retaining features attached to the patient interface.

Figure 7A:
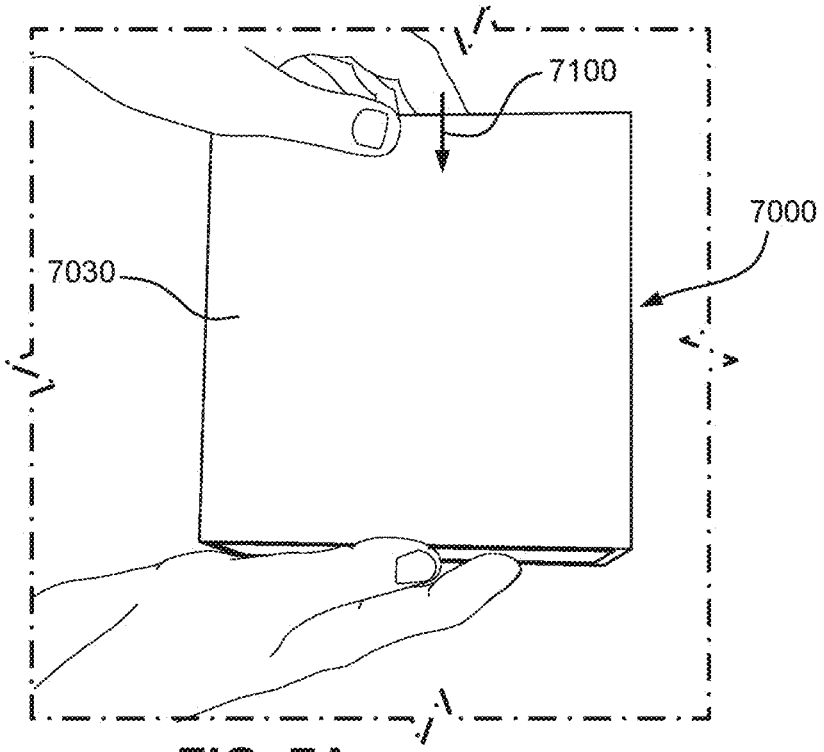

FIG. 7A shows a top view of the packaging of FIGS. 6A to 6D at the start of an opening sequence.

Figure 7B:
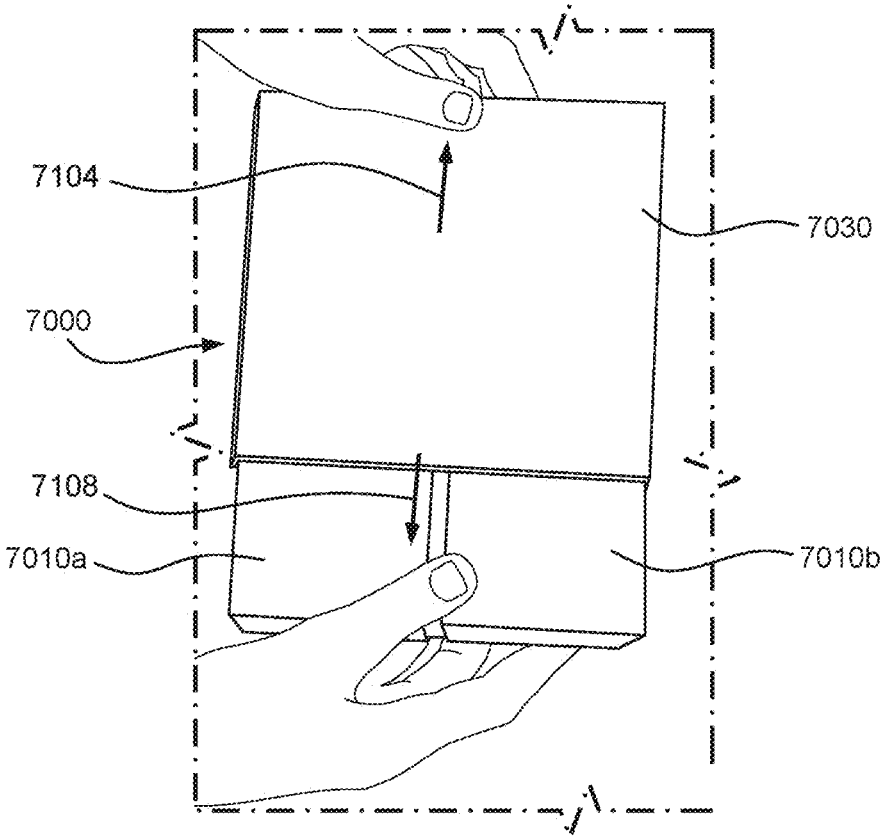

FIG. 7B shows a top view of the packaging part-way through the opening sequence with a sleeve of the packaging partially removed.

Figure 7C:
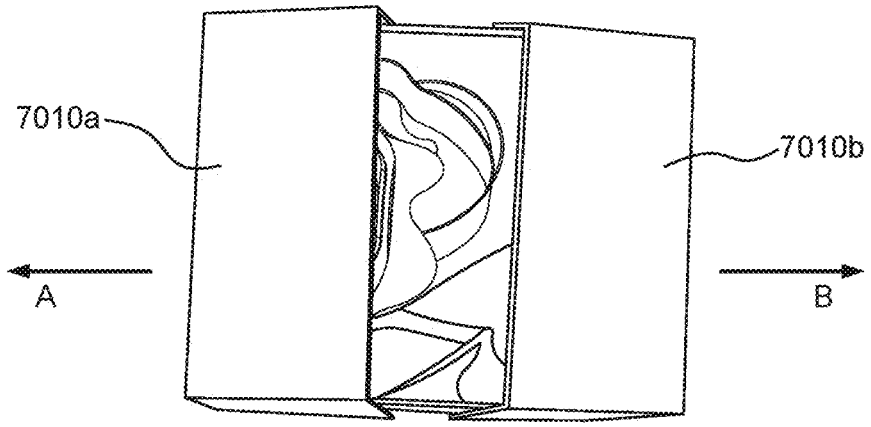

FIG. 7C shows a top view of the packaging part-way through the opening sequence with the sleeve fully removed.

Figure 7D:
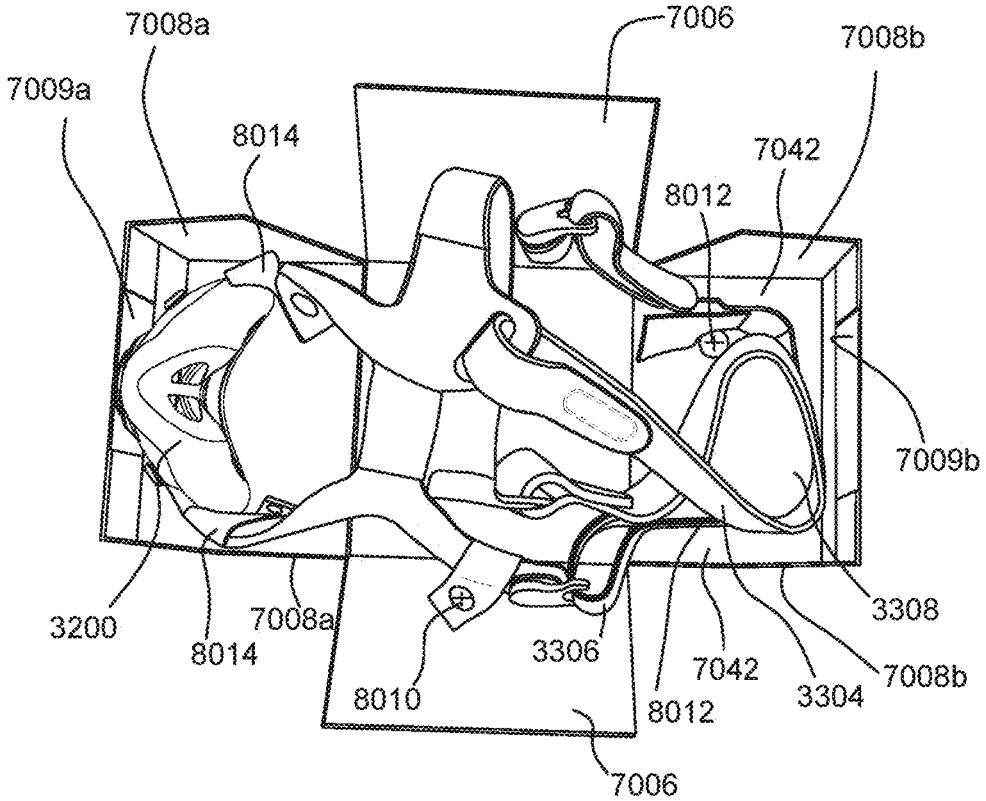

FIG. 7D shows a top view of the packaging at the end of the opening sequence.

Figure 8A:
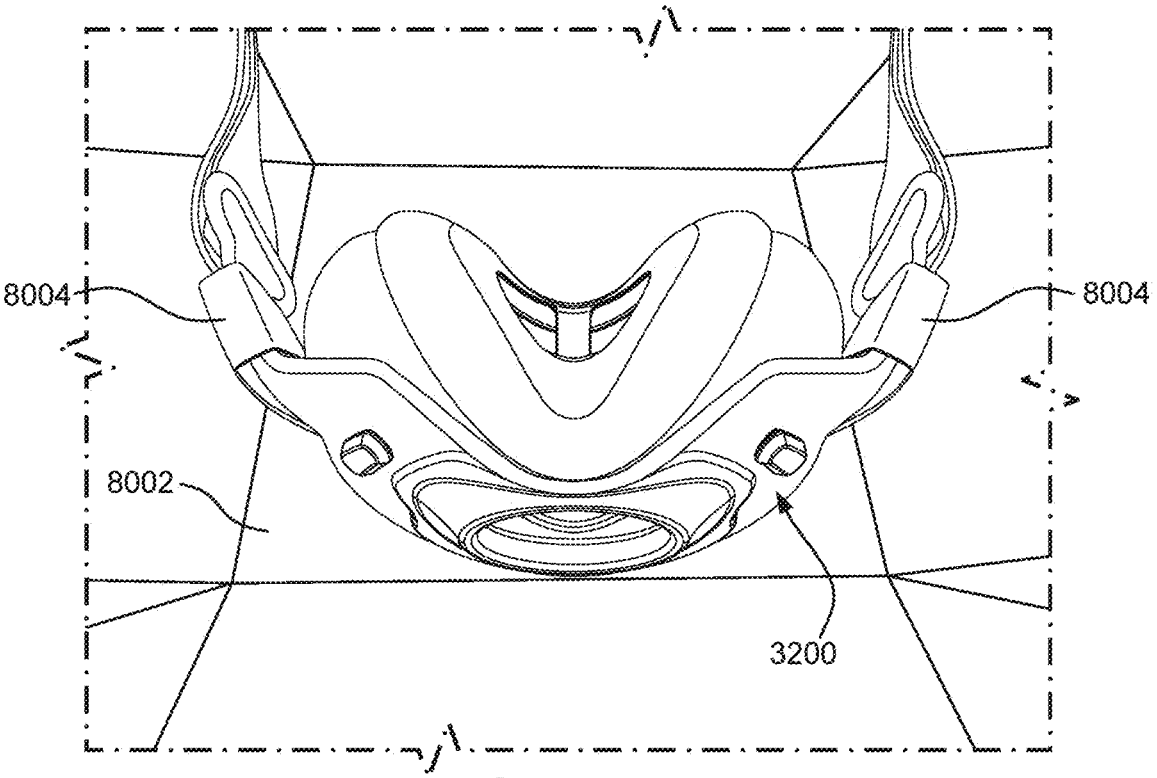

FIG. 8A shows a top view of packaging with an example of patient interface retaining features.

Figure 8B:
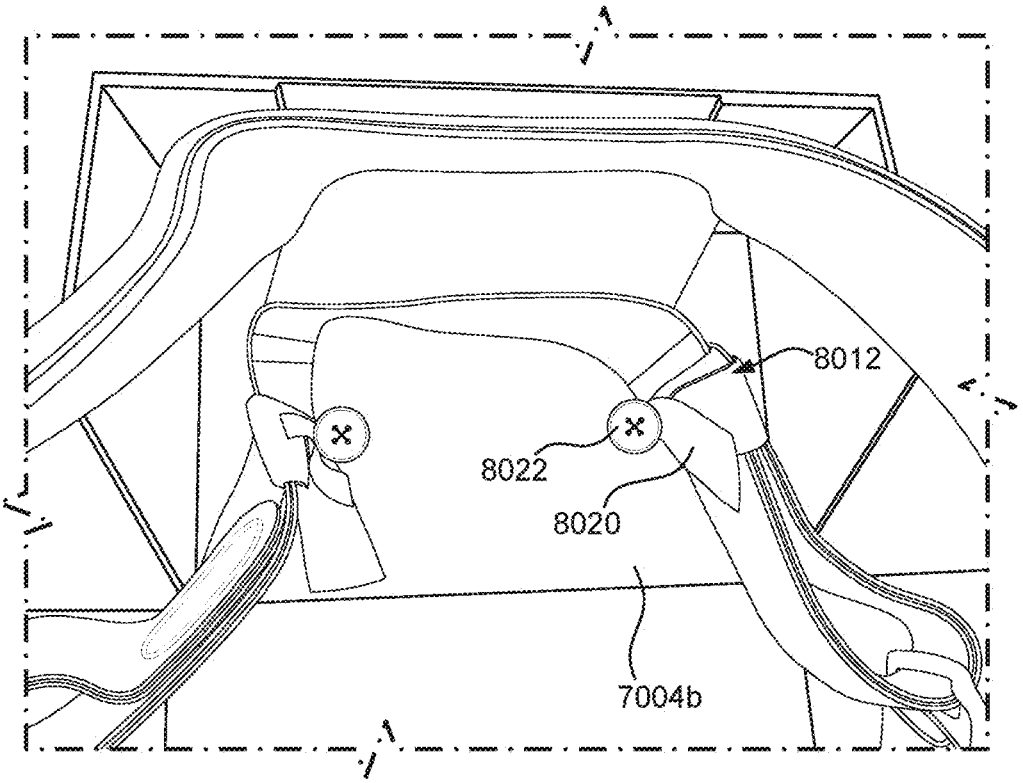

FIG. 8B shows a top view of packaging with another example of patient interface retaining features.

Figure 8C:
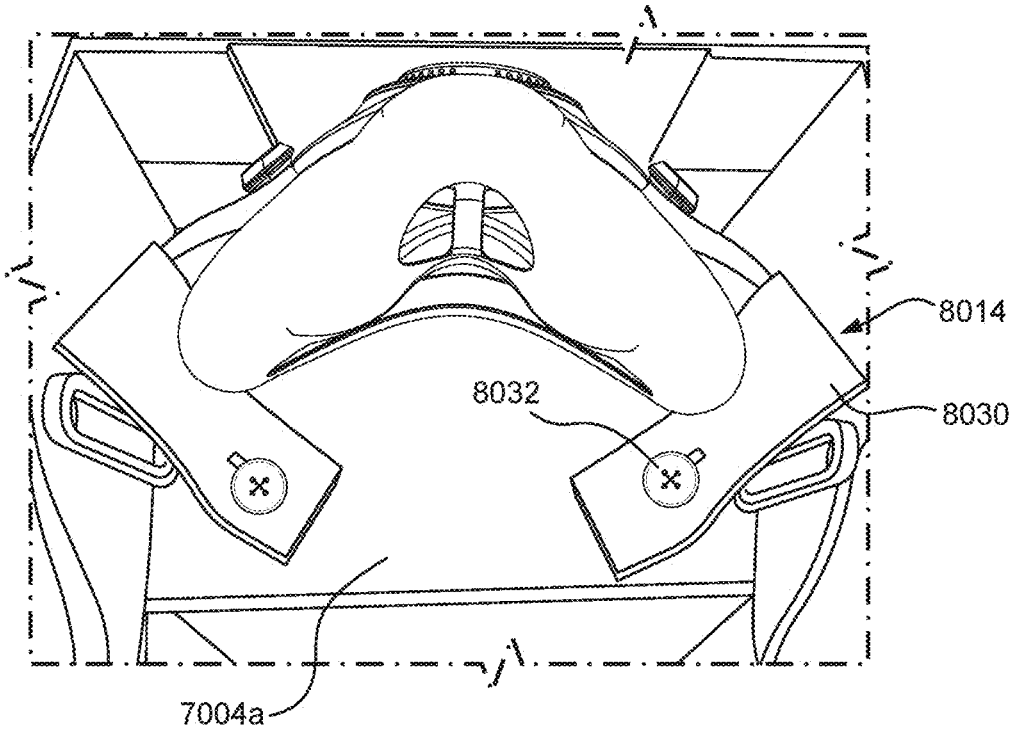

FIG. 8C shows a top view of packaging with a further example of patient interface retaining features.

Figure 8D:
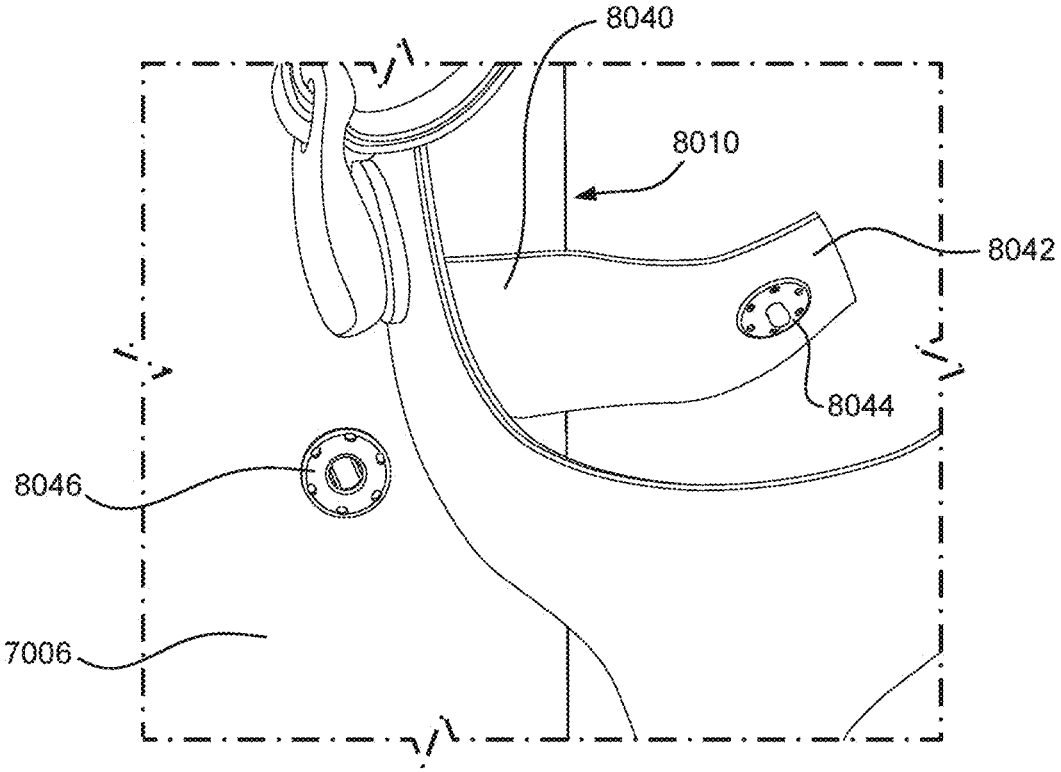
Figure 8E:
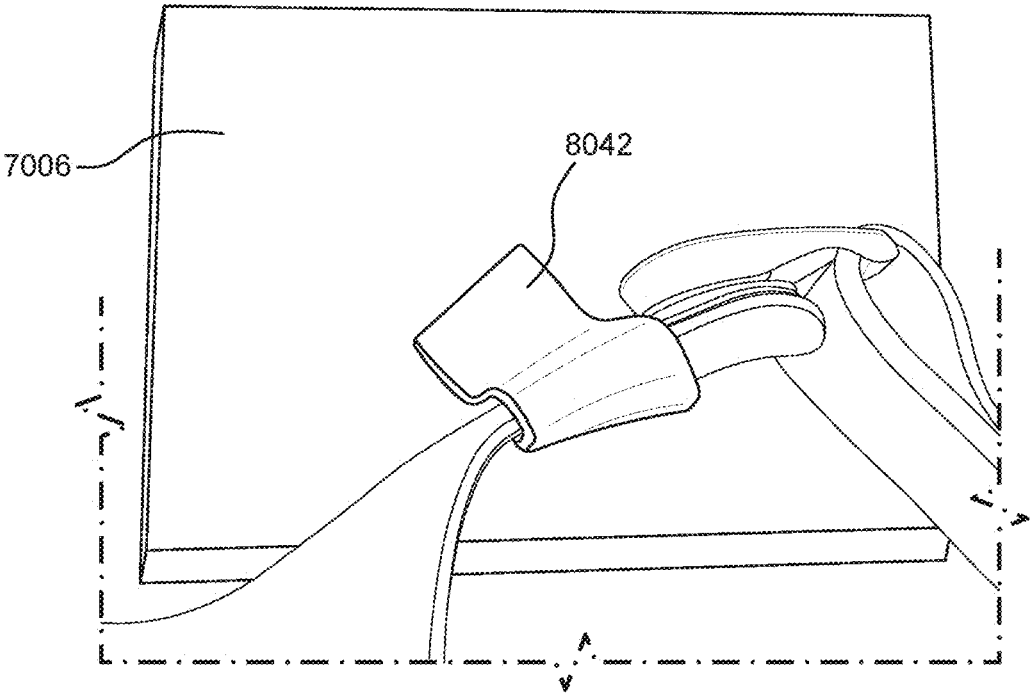

FIGS. 8D and 8E shows a top view of packaging with a yet further example of patient interface retaining features.

Figure 8F:
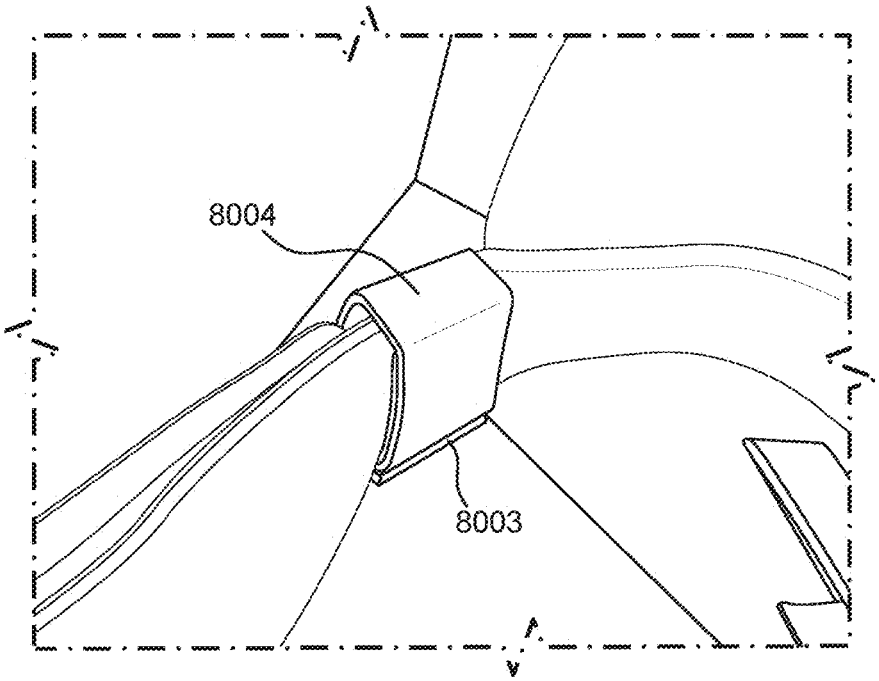

FIG. 8F is a close-up top perspective view of packaging with a yet further example of a patient interface retaining feature.

Figure 8G:
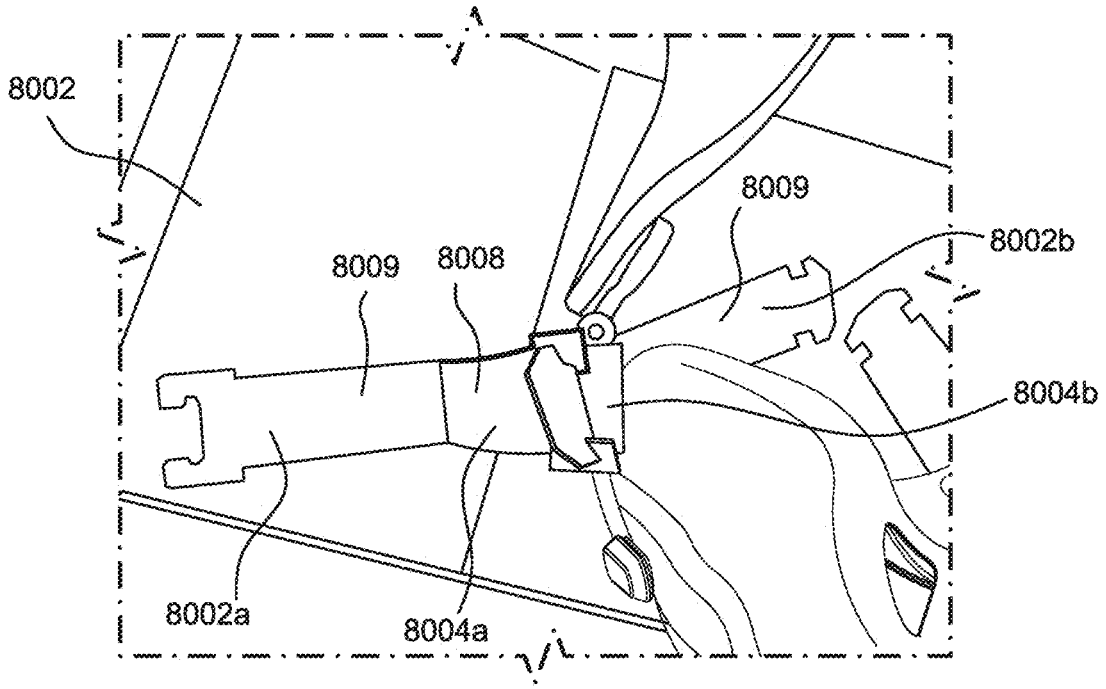

FIG. 8G shows a top view of packaging with a yet further example of patient interface retaining features.

Figure 9A:
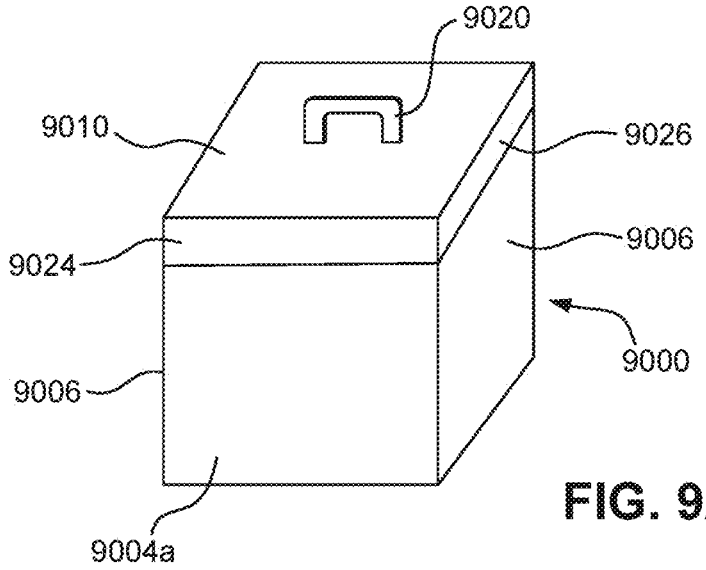

FIG. 9A shows a front perspective view of packaging for a patient interface in accordance with an example of the present technology, in a closed configuration.

Figure 9B:
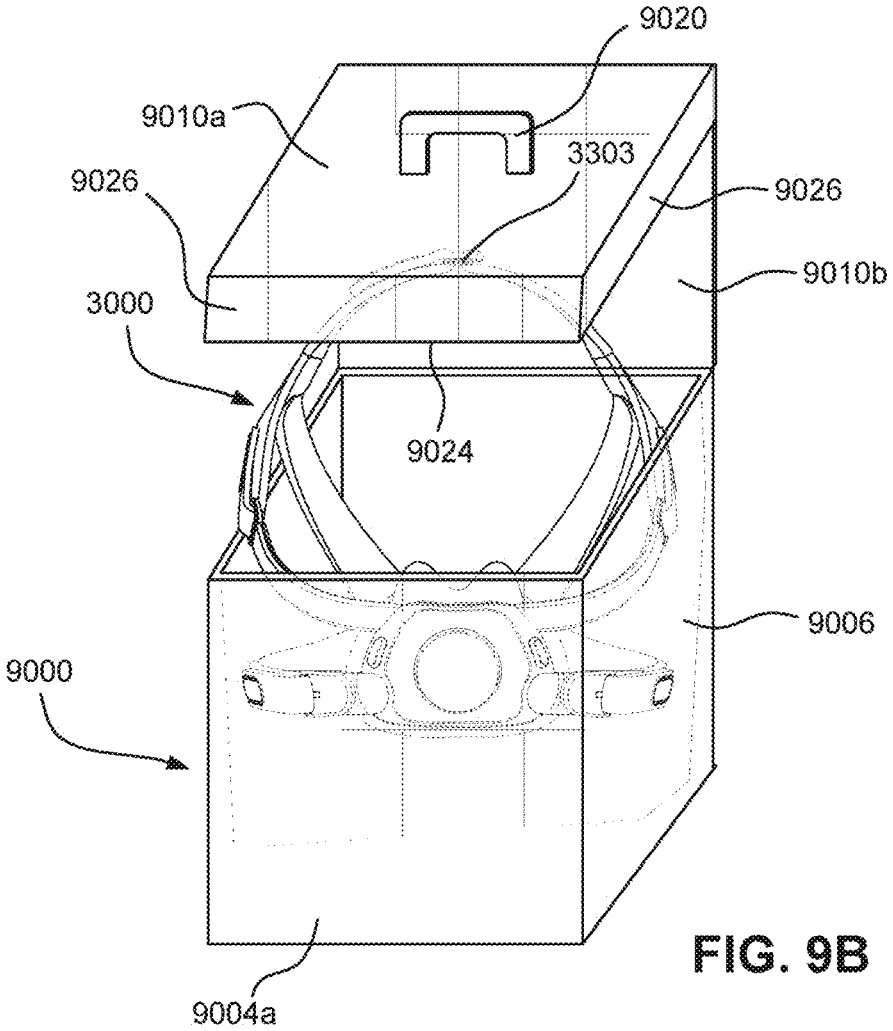

FIG. 9B shows a front perspective view of the packaging of FIG. 9A, partially opened.

Figure 9C:
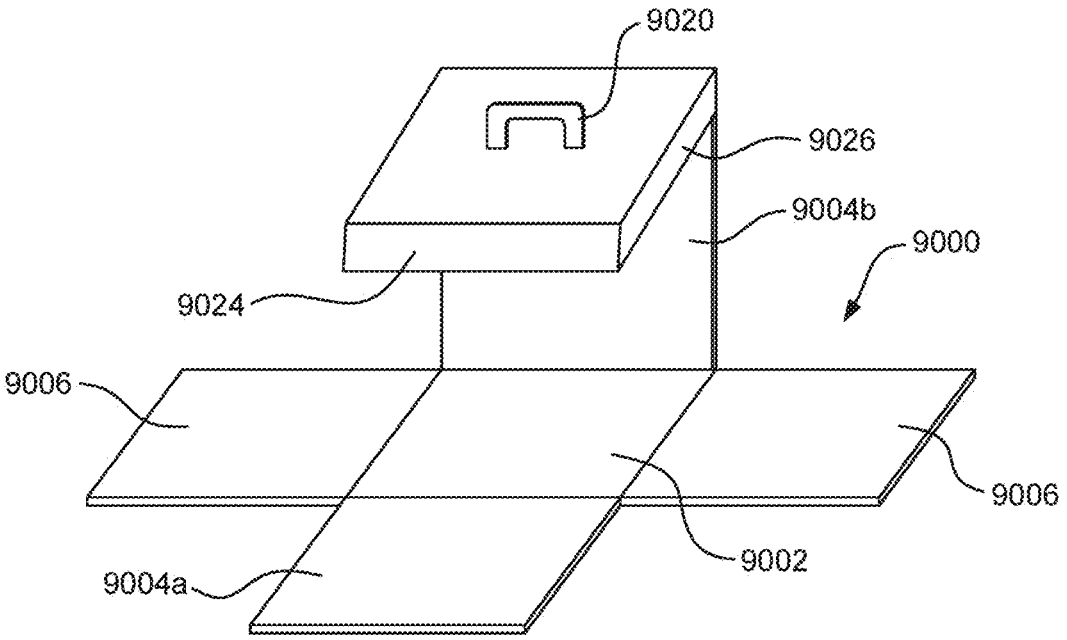

FIG. 9C shows a front perspective view of the packaging of FIG. 9A, fully opened and without the patient interface.

Figure 9D:
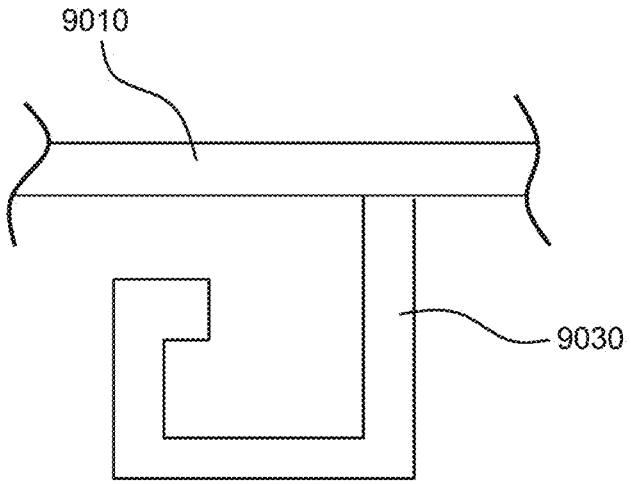

FIG. 9D shows a patient interface retaining feature of the packaging of FIG. 9A.

5 DETAILED DESCRIPTION OF EXAMPLES OF THE TECHNOLOGY

Before the present technology is described in further detail, it is to be understood that the technology is not limited to the particular examples described herein, which may vary. It is also to be understood that the terminology used in this disclosure is for the purpose of describing only the particular examples discussed herein, and is not intended to be limiting.

The following description is provided in relation to various examples which may share one or more common characteristics and/or features. It is to be understood that one or more features of any one example may be combinable with one or more features of another example or other examples. In addition, any single feature or combination of features in any of the examples may constitute a further example.

5.1 THERAPY

In one form, the present technology comprises a method for treating a respiratory disorder comprising applying positive pressure to the entrance of the airways of a patient 1000.

In certain examples of the present technology, a supply of air at positive pressure is provided to the nasal passages of the patient via one or both nares.

In certain examples of the present technology, mouth breathing is limited, restricted or prevented.

5.2 RESPIRATORY THERAPY SYSTEMS

In one form, the present technology comprises a respiratory therapy system for treating a respiratory disorder. The respiratory therapy system may comprise an RPT device 4000 for supplying a flow of air to the patient 1000 via an air circuit 4170 and a patient interface 3000.

5.3 PATIENT INTERFACE

A non-invasive patient interface 3000 in accordance with one aspect of the present technology comprises the following functional aspects: a seal-forming structure 3100, a plenum chamber 3200, a positioning and stabilising structure 3300, a vent 3400, one form of connection port 3600 for connection to air circuit 4170, and a forehead support 3700. In some forms a functional aspect may be provided by one or more physical components. In some forms, one physical component may provide one or more functional aspects. In use the seal-forming structure 3100 is arranged to surround an entrance to the airways of the patient so as to maintain positive pressure at the entrance(s) to the airways of the patient 1000. The sealed patient interface 3000 is therefore suitable for delivery of positive pressure therapy.

If a patient interface is unable to comfortably deliver a minimum level of positive pressure to the airways, the patient interface may be unsuitable for respiratory pressure therapy.

The patient interface 3000 in accordance with one form of the present technology is constructed and arranged to be able to provide a supply of air at a positive pressure of at least 6 cmH2O with respect to ambient.

The patient interface 3000 in accordance with one form of the present technology is constructed and arranged to be able to provide a supply of air at a positive pressure of at least 10 cmH2O with respect to ambient.

The patient interface 3000 in accordance with one form of the present technology is constructed and arranged to be able to provide a supply of air at a positive pressure of at least 20 cmH2O with respect to ambient.

5.3.1 Seal-Forming Structure

In one form of the present technology, a seal-forming structure 3100 provides a target seal-forming region, and may additionally provide a cushioning function. The target seal-forming region is a region on the seal-forming structure 3100 where sealing may occur. The region where sealing actually occurs—the actual sealing surface—may change within a given treatment session, from day to day, and from patient to patient, depending on a range of factors including for example, where the patient interface was placed on the face, tension in the positioning and stabilising structure and the shape of a patient's face.

5.3.1.1 Nasal Pillows

In one form the seal-forming structure of the non-invasive patient interface 3000 comprises a pair of nasal puffs, or nasal pillows, each nasal puff or nasal pillow being constructed and arranged to form a seal with a respective naris of the nose of a patient.

5.3.2 Plenum Chamber

The plenum chamber 3200 has a perimeter that is shaped to be complementary to the surface contour of the face of an average person in the region where a seal will form in use. In use, a marginal edge of the plenum chamber 3200 is positioned in close proximity to an adjacent surface of the face. Actual contact with the face is provided by the seal-forming structure 3100. The seal-forming structure 3100 may extend in use about the entire perimeter of the plenum chamber 3200. In some forms, the plenum chamber 3200 and the seal-forming structure 3100 are formed from a single homogeneous piece of material.

5.3.3 Positioning and Stabilising Structure

The seal-forming structure 3100 of the patient interface 3000 of the present technology may be held in sealing position in use by the positioning and stabilising structure 3300.

In one form of the present technology, a positioning and stabilising structure 3300 is provided with a decoupling portion located between an anterior portion of the positioning and stabilising structure 3300, and a posterior portion of the positioning and stabilising structure 3300. The decoupling portion does not resist compression and may be, e.g. a flexible or floppy strap. The decoupling portion is constructed and arranged so that when the patient lies with their head on a pillow, the presence of the decoupling portion prevents a force on the posterior portion from being transmitted along the positioning and stabilising structure 3300 and disrupting the seal.

In one form of the present technology, a positioning and stabilising structure 3300 comprises a strap constructed from a laminate of a fabric patient-contacting layer, a foam inner layer and a fabric outer layer. In one form, the foam is porous to allow moisture, (e.g., sweat), to pass through the strap. In one form, the fabric outer layer comprises loop material to engage with a hook material portion.

In certain forms of the present technology, a positioning and stabilising structure 3300 comprises a strap that is extensible, e.g. resiliently extensible. For example the strap may be configured in use to be in tension, and to direct a force to draw a seal-forming structure into sealing contact with a portion of a patient's face. In an example the strap may be configured as a tie.

Figure 1:
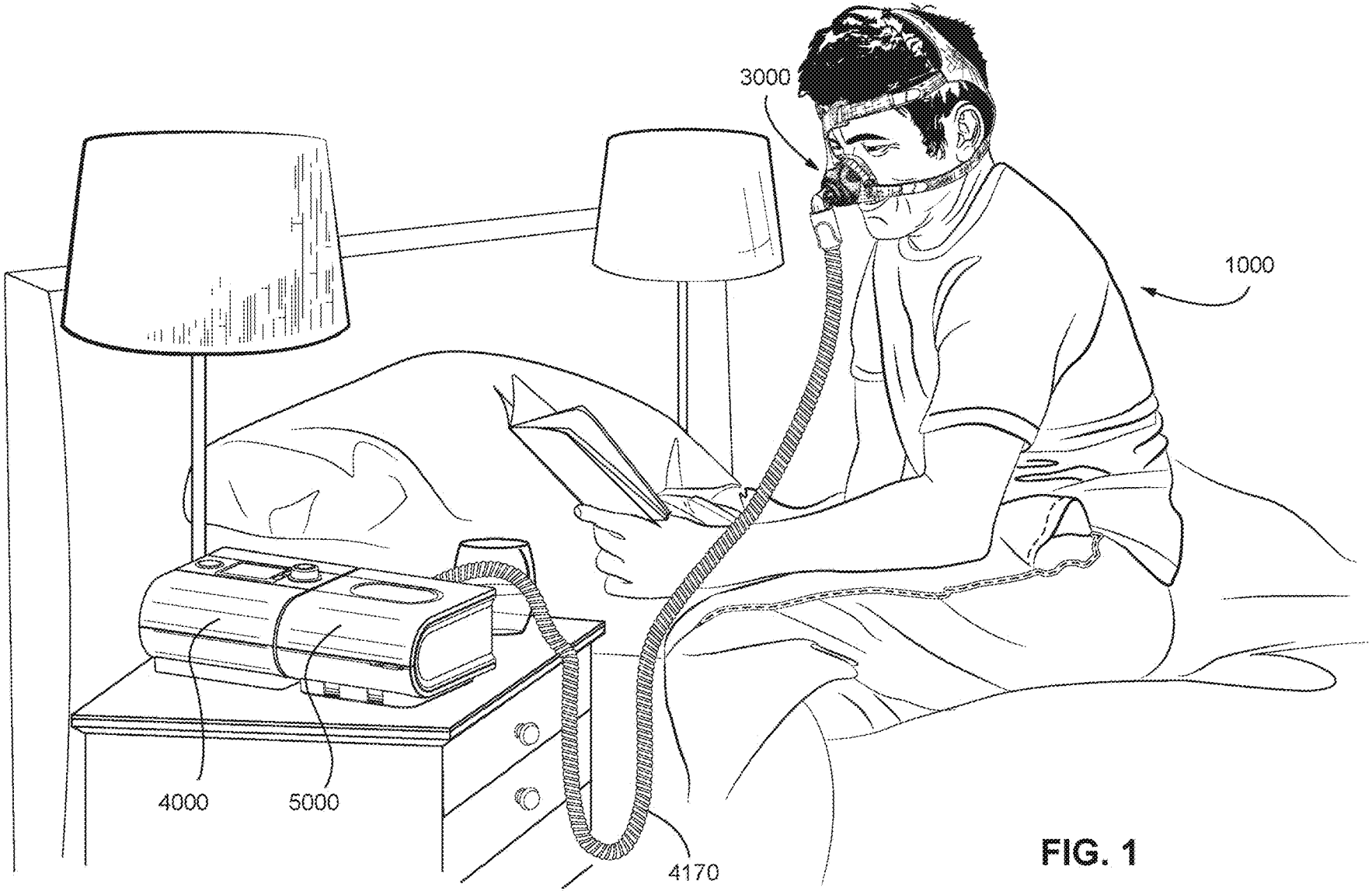
Figure 2:
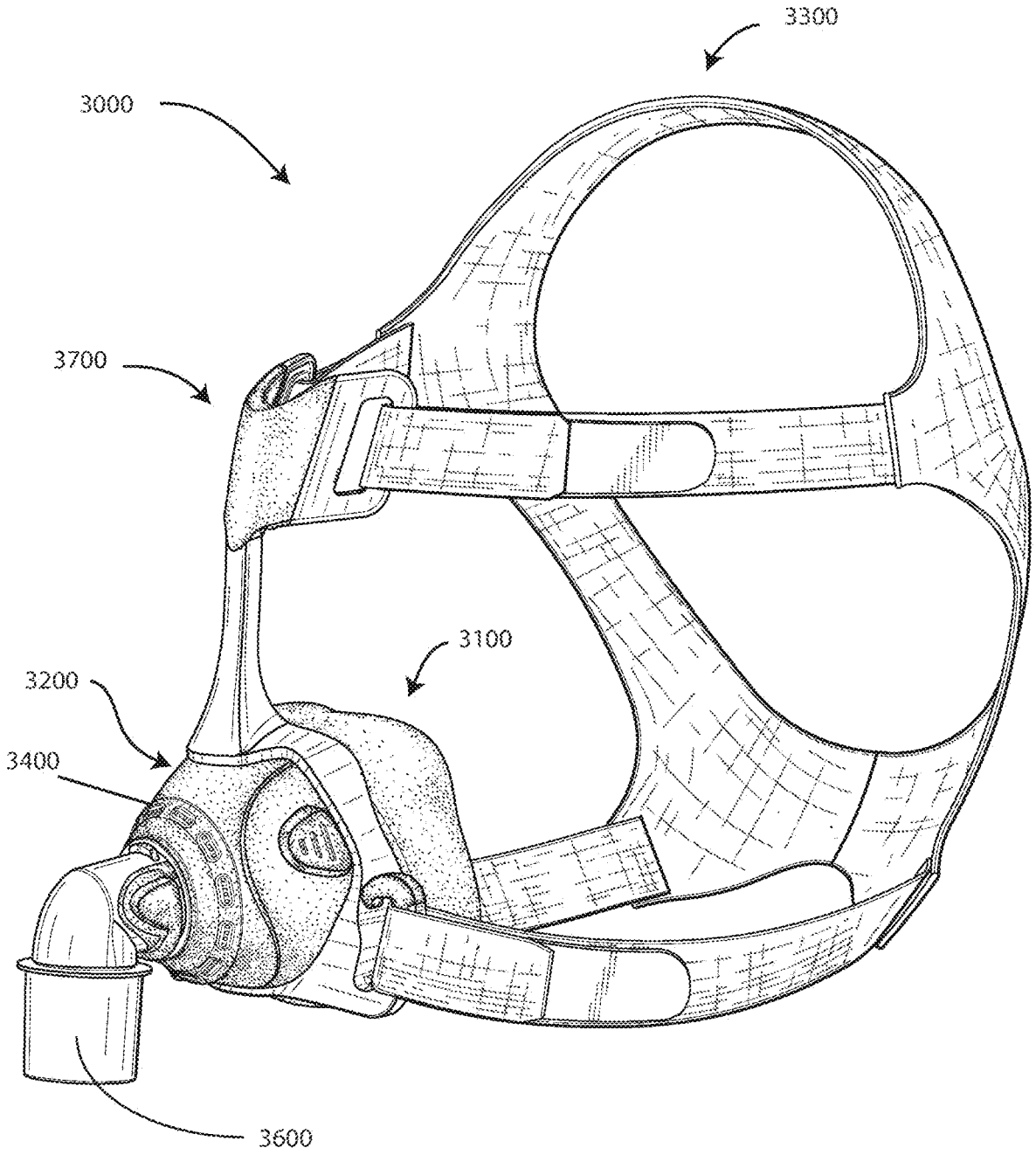
FIG. 2 shows a patient interface in the form of a nasal mask in accordance with one form of the present technology.
Figure 3A:
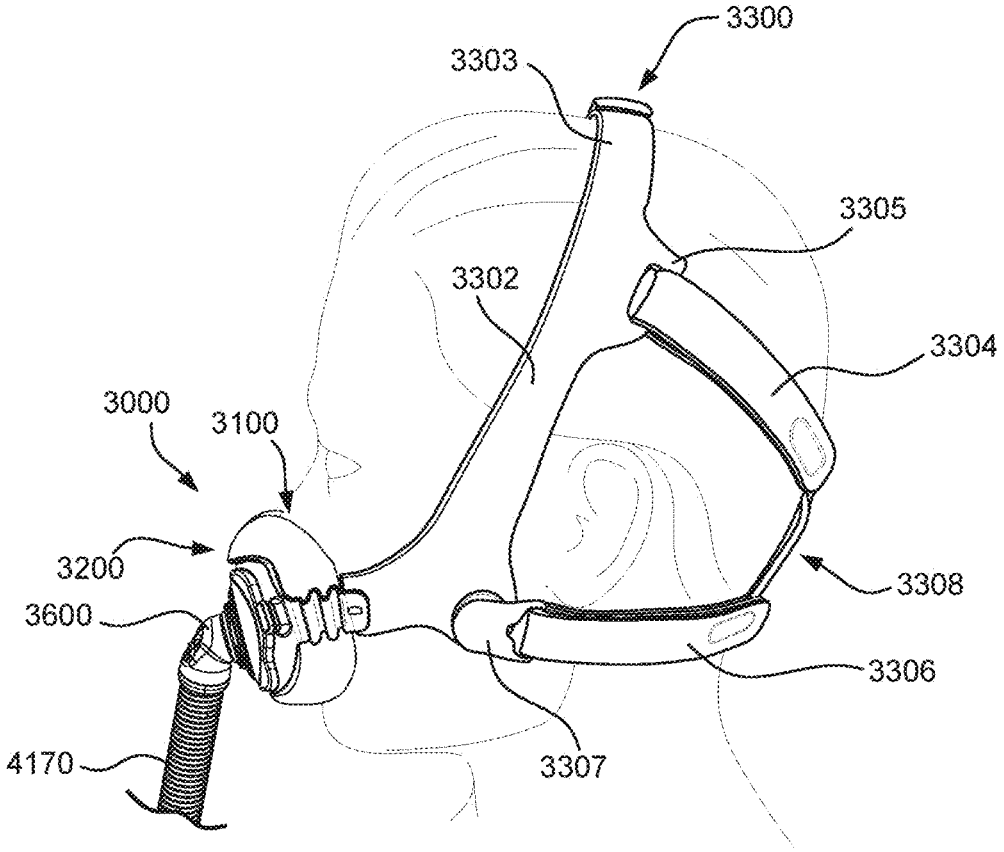
FIG. 3A shows a side view of a patient interface in accordance with one form of the present technology.
Figure 3B:
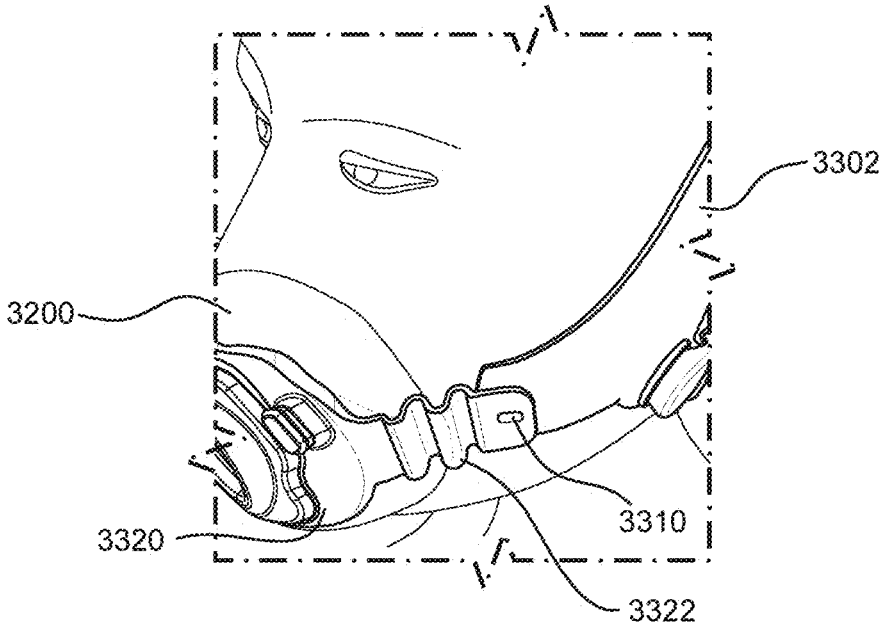
FIG. 3B shows a close-up side perspective view of the patient interface of FIG. 3A.
Figure 3C:
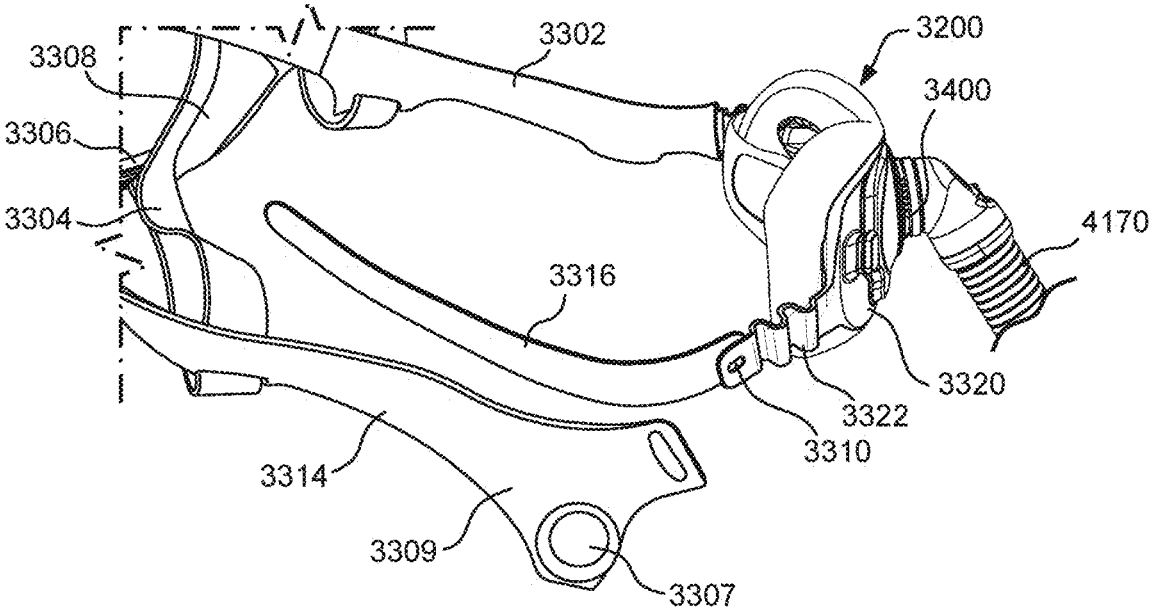
FIG. 3C shows part of the patient interface of FIG. 3A in partially disassembled form, with a rigidizer of the patient interface exposed.
Figure 3D:
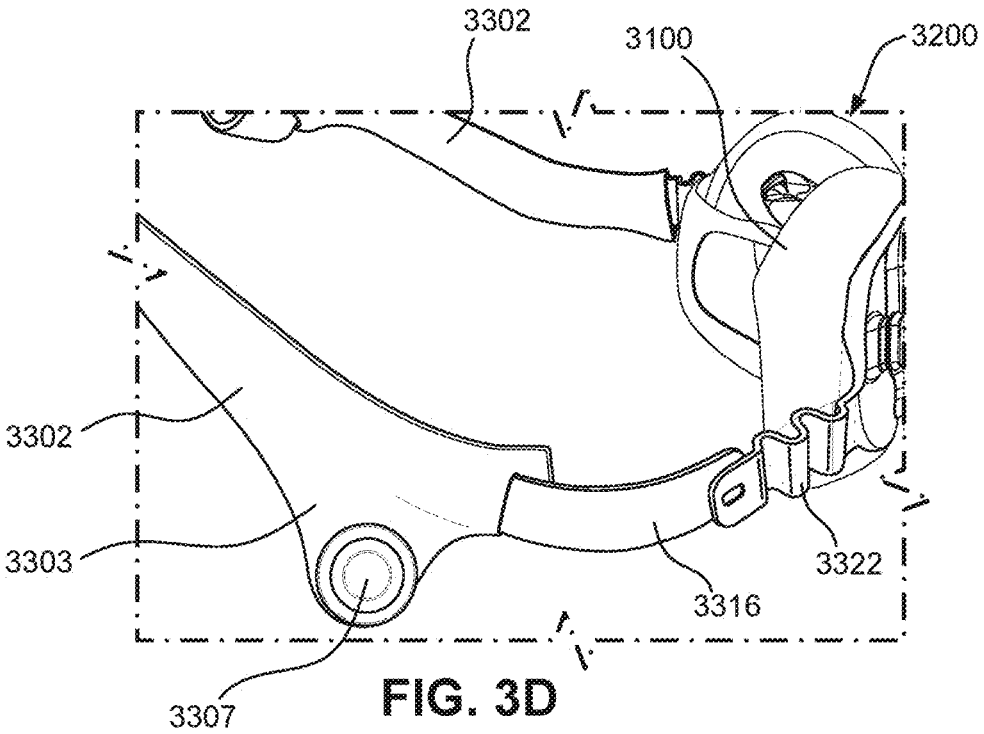
FIG. 3D shows the part of the patient interface with the rigidizer inserted into a strap.

In one form of the present technology, the positioning and stabilising structure comprises a first tie (e.g. first tie 3304 in FIG. 3A and FIG. 3C), the first tie being constructed and arranged so that in use at least a portion of an inferior edge thereof passes superior to an otobasion superior of the patient's head and overlays a portion of a parietal bone without overlaying the occipital bone.

In one form of the present technology suitable for a nasal-only mask or for a full-face mask, the positioning and stabilising structure includes a second tie (e.g. second tie 3306 in FIG. 3A and FIG. 3C), the second tie being constructed and arranged so that in use at least a portion of a superior edge thereof passes inferior to an otobasion inferior of the patient's head and overlays or lies inferior to the occipital bone of the patient's head.

In one form of the present technology suitable for a nasal-only mask or for a full-face mask, the positioning and stabilising structure includes a third tie (e.g. strap connector 3308 in FIG. 3A and FIG. 3C) that is constructed and arranged to interconnect the first tie and the second tie to reduce a tendency of the first tie and the second tie to move apart from one another.

In certain forms of the present technology, a positioning and stabilising structure 3300 comprises a strap that is bendable and e.g. non-rigid. An advantage of this aspect is that the strap is more comfortable for a patient to lie upon while the patient is sleeping.

In certain forms of the present technology, a positioning and stabilising structure 3300 comprises a strap constructed to be breathable to allow moisture vapour to be transmitted through the strap.

One example of a strap 3302 is shown in FIGS. 3A-3D. The strap 3302 comprises a fabric outer layer 3314 that forms a sleeve for a rigidizer 3316. A "rigidizer" means and includes any reinforcing element that increases the rigidity of another item and may include an object that increases rigidity in one or more axes. The rigidizer 3316 may be resiliently flexible along at least part of its length.

In some forms of the present technology, with reference to FIGS. 3A to 3D, the strap 3302 may be connected directly or indirectly to the plenum chamber 3200 via a concertina section 3322. For example, the concertina section 3322 may extend directly from the plenum chamber 3200 itself, or may extend from a rigid outer shell 3320 that connects to a soft and/or resilient plenum chamber 3200. The strap 3302 may be connected to the concertina section 3322 via an end 3310 of rigidizer 3316, for example.

In some forms, the strap 3302 may comprise a tab 3309 comprising a connector 3307 for connecting the strap 3302 to the second tie 3306. The connector 3307 may comprise a button or press stud, for example.

In some forms of the present technology, the positioning and stabilising structure 3300 may comprise a pair of straps 3302 that are connected by a crown tie 3303. The crown tie 3303 may be adjustable in length for better fitting of the positioning and stabilising structure 3300 to the patient's head.

In some forms, each of the pair of straps 3302 may be connected to the first tie 3304 via a tab 3305. The tab 3305 may include a loop that permits the first tie 3304 to be threaded through and removably connected in an adjustable manner to adjust the length of the strap 3304.

In certain forms of the present technology, a system is provided comprising more than one positioning and stabilizing structure 3300, each being configured to provide a retaining force to correspond to a different size and/or shape range. For example the system may comprise one form of positioning and stabilizing structure 3300 suitable for a large sized head, but not a small sized head, and another. suitable for a small sized head, but not a large sized head.

5.3.4 Vent

In one form, the patient interface 3000 includes a vent 3400 constructed and arranged to allow for the washout of exhaled gases, e.g. carbon dioxide.

The vent 3400 may be located in the plenum chamber 3200. Alternatively, the vent 3400 is located in a decoupling structure, e.g., a swivel.

5.3.5 Decoupling Structure(s)

In one form the patient interface 3000 includes at least one decoupling structure, for example, a swivel or a ball and socket.

5.3.6 Connection Port

Connection port 3600 allows for connection to the air circuit 4170.

5.3.7 Forehead Support

In one form, the patient interface 3000 includes a forehead support 3700.

5.3.8 Ports

In one form of the present technology, a patient interface 3000 includes one or more ports that allow access to the volume within the plenum chamber 3200. In one form this allows a clinician to supply supplementary oxygen. In one form, this allows for the direct measurement of a property of gases within the plenum chamber 3200, such as the pressure.

5.4 PACKAGING FOR A PATIENT INTERFACE

One form of the present technology comprises packaging for a patient interface. The patient interface may be a patient interface 3000 of the type depicted in FIG. 2 and FIGS. 3A-3D, though it will be appreciated that the packaging may be used with many other types of patient interface with suitable modification.

In one form, as shown in FIGS. 4A to 4D, packaging 6000 for a patient interface 3000 comprises a plurality of panels 6004*a*, 6004*b*, 6006. The plurality of panels is arranged to be folded inwardly to define a housing for the patient interface 3000.

In this example, the plurality of panels comprises a first end panel 6004*a* comprising a first panel portion 6034 and a second panel portion 6036 that are joined at a fold 6040. First panel portion 6034 may be folded inwardly (i.e., in the direction of second panel portion 6036) about fold 6040 to a generally upright position to form a first end wall of the housing for the patient interface. Second panel portion 6036 thus forms a bottom wall of the housing. In some forms, the upright position may be where the first panel portion 6034 is substantially perpendicular to the second panel portion 6036.

The plurality of panels also comprises a second end panel 6004*b* that comprises a first panel portion 6021 and a second panel portion 6022 that are joined at a fold 6030 at one end of the first panel portion 6021. The first panel portion 6021 is joined at its other end to the first end panel 6004*a* via another fold 6032. The first panel portion 6021 is inwardly foldable (i.e., in the direction of first end panel 6004*a*) about the fold 6032 to a generally upright position to form a second end wall of the housing for the patient interface 3000. In some forms, the upright position may be where the first panel portion 6021 is substantially perpendicular to the second panel portion 6036. In this position, the first panel portion 6034 and the first panel portion 6021 may be substantially parallel to one another.

The plurality of panels further comprises a pair of opposed side panels 6006. Each side panel 6006 may be connected to first end panel 6004*a* via a fold 6007, e.g. at the second panel portion 6036 of the first end panel 6004*a*. Each side panel 6006 is inwardly foldable (i.e., in the direction of the first end panel 6004*a*) about its respective fold 6007 to a generally upright position to form a side wall of the housing for the patient interface 3000. In some forms, the upright position may be where at least one of the side panels 6006 is substantially perpendicular to the second panel portion 6036. In this position, the side panels 6006 may be substantially parallel to one another. However, other examples may include one or more side panels 6006 inclined with respect to the second panel portion 6036 and or the other side panels 6006 in the upright position.

The second panel portion 6022 of second end panel 6004*b*, as well as being foldable about the fold 6032, is also inwardly foldable (i.e., in the direction of the first panel portion 6021) about fold 6030 such that the second panel portion 6022 forms a top wall of the housing for the patient interface 3000. The top wall 6022 thus forms part of a lid 6020 for the packaging 6000.

The lid 6020 may further comprise an end flap 6024 extending generally perpendicular to the top wall 6022. When the first end panel 6004*a* is folded inwardly about fold line 6040, and the second end panel 6004*b* is folded inwardly about the fold lines 6032 and 6030, the end flap 6024 of the lid 6020 may engage with an external surface of the first panel portion 6034 of the first end panel 6004*a*. The end flap 6024 acts as a panel-retaining structure to prevent outward collapse of the first end panel 6004*a* (specifically, in this case, the first panel portion 6034 of the first end panel 6004*a*).

In some forms, the end flap 6024 may be retained in its illustrated position in FIG. 4A relative to the top wall 6022. This may allow the end flap 6024 to act as a backstop and not move (e.g., pivot) when contacted by the first end panel portion 6034, which enables the end flap 6024 to act as the panel-retaining structure.

As shown, the end flap 6024 has a height that is substantially equal to a height of the end wall defined by the first panel portion 6034 of the first end panel 6004*a*. However, it will be appreciated that in some forms, the flap 6024 may be smaller than this and still act as a panel-retaining structure, or part thereof.

The lid 6020 may also comprise a pair of opposed side flaps 6026 that extend mutually perpendicularly to the top wall 6022 and the end flap 6024. The side flaps 6026 may be connected to both the top wall 6022 and the end flap 6024. Accordingly, when side panels 6006, first end panel 6004*a* and second end panel 6004*b* are all folded inwardly, each side flap 6026 of the lid 6020 may be arranged to engage with respective external surfaces of the side panels 6006 in their upright position, and thus act as part of a panel-retaining structure that also comprises the end flap 6024. The side flaps 6026 may, but need not, each have a height that is substantially equal to a height of the side panels 6006.

As shown, the lid 6020 has flaps 6024, 6026 that are connected to each other such that they do not move with respect to each other. Additionally, the end flap 6024 and/or the side flaps 6026 may not move relative to the top wall 6022. Accordingly, when the lid 6020 is folded over and its internal surfaces engage with the external surfaces of first end panel 6004*a* and side panels 6006, the lid 6020 acts as a panel-retaining structure that encloses and prevents outward collapse of first end panel 6004*a* and side panels 6006.

Alternatively, flaps 6024 and 6026 may be separated from each other such that they are movable with respect to each other. When the lid 6020 is folded over and its internal surface engages with the external surfaces of the first end panel 6004*a* and side panels 6006, an additional retaining means such as a magnet may be disposed between the internal surfaces and the external surfaces such that the lid 6020 may act as a panel-retaining structure that encloses and prevents outward collapse of the first end panel 6004*a* and side panels 6006. This configuration allows the packaging to be substantially flattened when opened.

In some forms, respective pairs of panels 6004*a*, 6004*b*, 6006 may be joined by a foldable web 6010. As shown in FIG. 4A, each foldable web 6010 may comprise a pair of substantially triangular portions 6012 joined at a fold 6014. The webs 6010 are inwardly foldable about the fold 6014 as panels 6004*a*, 6004*b*, 6006 are inwardly folded, such that the substantially triangular portions 6012 are flattened against each other when the packaging 6000 is closed. By providing webs 6010 between the panels, folding of the panels to form the housing for the patient interface 3000 is made easier.

In some forms, the inwardly folded webs 6010 may extend at least partially across the second panel portion 6036, thereby reducing the internal volume of the packaging 6000. This may be beneficial in creating less room for the patient interface to move within the packaging 6000.

At least one panel of the packaging 6000 further comprises at least one patient interface retaining feature that is attachable to the patient interface 3000. Various examples of such retaining features are shown in FIGS. 8A to 8G and will be described in further detail below. In some forms, each of the end panels and the side panels may comprise one or more patient interface retaining features.

For example, the second panel portion 6036 of the first end panel 6004*a* may comprise one or more patient interface retaining features 8004*a*, 8004*b* (FIGS. 4C, 4D, 8G) arranged to attach to the patient interface 3000 at or near the plenum chamber 3200. In some examples, the one or more patient interface retaining features are arranged to attach on either side of the plenum chamber 3200 (FIG. 4D). For example, attachment may be at the concertina portions 3322 of the patient interface 3000 (see e.g., FIGS. 3C and 3D) on either side, and/or near the connection points 3310 of the straps 3302 to the plenum chamber 3200. As shown in FIGS. 4C and 4D, the patient interface retaining features 8004*a* and 8004*b* are configured to be engageable with each other in order to retain the patient interface 3000 within the package. In other words, the patient interface retaining features 8004*a* and 8004*b* do not mate with the patient interface 3000.

Alternatively, the patient interface retaining features 8004*a* and 8004*b* may be engageable with itself in order to retain the patient interface 3000 within the package. Each retaining feature 8004*a*, 8004*b* may not mate with the patient interface 3000. Instead, each retaining feature 8004, 8004*b* by be wrapped around a portion of the patient interface 3000 and folded against itself.

Alternatively, the patient interface 3000 may comprise a complementary mating means for engaging with the patient interface retaining features 8004*a*, 8004*b*. The complementary mating means may be defined by the patient interface 3000, or may be additional to the patient interface 3000.

The one or more patient interface retaining features 8004*a*, 8004*b* preferably do not contact the seal-forming structure 3100, for hygiene purposes.

In some forms, the one or more patient interface retaining features 8004*a*, 8004*b* are arranged on the first end panel 6004*a* to provide a clearance between the patient interface 3000 and the panels 6004*a*, 6006 when the patient interface 3000 is attached. For example, the one or more patient interface retaining features 8004*a*, 8004*b* may be arranged such that there is a sufficient clearance between the plenum chamber 3200 and the first panel portion 6034 to prevent transfer of any ink or other material from the internal surface of first panel portion 6034 to the plenum chamber 3200.

The one or more patient interface retaining features 8004*a*, 8004*b* (FIGS. 4C, 4D, 8G) may be magnetic and arranged to loop over the patient interface 3000 at or near the plenum chamber 3200. For example, retaining feature 8004*a* may comprise a magnet and retaining feature 8004*b* may comprise another magnet such that their unlike poles faces each other and configured for magnetic attraction. Retaining features 8004*a* and 8004*b* thus secures the patient interface 3000 within the loop formed when the magnets are attracted to each other. Alternatively, the magnetic patient interface retaining features may engage a complementary mating means on the patient interface 3000. The complementary mating means may be defined by the patient interface 3000, or may be additional to the patient interface 3000.

In some forms, the engageable nature of the patient interface retaining features 8004*a*, 8004*b* may allow them to mechanically connect to one another. This may be instead of or in addition to the magnetic connection described above. For example, magnetic attraction between the patient interface retaining features 8004*a*, 8004*b* may provide additional retention to better ensure that the patient interface retention features 8004*a*, 8004*b* stay connected to one another.

In certain forms, the patient interface retaining feature 8004*a* may include a free end with a pair of arms 8005 configured to form a groove 8006. The patient interface retaining feature 8004*b* may include an overhang 8007 with a narrow portion proximate to the free end. The groove 8006 may be a female part that receives the narrow portion (e.g., a male part) so that the pair of arms 8005 wrap around the patient interface retaining feature 8004*b* and selectively lock the two features together. The patient interface retaining feature 8004*b* may be slightly rotated (e.g., bent, turned, flexed, etc.) relative to the patient interface retaining feature 8004*a* in order to disengage the two features from one another.

In some forms, each of the side panels 6006 may comprise at least one patient interface retaining feature 8004*a* arranged to attach to respective sides of the patient interface 3000. For example, the at least one patient interface retaining structure may attach to the second tie 3306 at a point intermediate the connector 3307 and the third tie 3308. In some forms, the at least one patient interface retaining feature 8004*a* may attach to the second tie 3306 at a point at or near the connector 3307. In some forms, one patient interface retaining feature 8004*a* may attach to the second tie 3306 at a point at or near the connector 3307 and another patient interface retaining feature 8004*a* may attach to the second tie 3306 at a point at or near the third tie 3308. In some forms, the second tie 3306, the connector 3307, the third tie 3308, and/or any point intermediate these entities may each independently comprise a magnet in order to correspondingly be attracted to a magnetic retaining feature 8004*a* on each of the side panels 6006.

In some forms, the first panel portion 6021 and/or the second panel portion 6022 of the second end panel 6004*b* may comprise one or more patient interface retaining features arranged to attach to the patient interface 3000 at or near the third tie 3308. In some examples, the one or more patient interface retaining features are arranged to attach on either side of the third tie 3308. For example, attachment may be to the second tie 3306 on either side of the third tie 3308. In some forms, the third tie 3308 or any point near the third tie 3308 may comprise a magnet in order to correspondingly be attracted to a magnetic retaining structure on the first panel portion 6021 and/or the second panel portion 6022.

In some forms, the one or more patient interface retaining features are arranged on the second end panel 6004*b* to provide a clearance between the patient interface 3000 and the second end panels 6004*b* when the patient interface 3000 is attached. For example, the one or more patient interface retaining features 8004*a*, 8004*b* may be arranged such that there is a sufficient clearance between the third tie 3308 and second tie 3306, and the end flap 6024, such that when the lid 6020 is closed over the side panels 6006 and first end panel 6004*a*, the second tie 3306 and third tie 3308 do not interfere with the closing.

In some forms, second panel portion 6036 may comprise at least one patient interface retaining feature 8004*b* arranged to attach to respective sides of the patient interface 3000. For example, the at least one patient interface retaining structure may attach to the second tie 3306 at a point intermediate the connector 3307 and the third tie 3308. In some forms, the at least one patient interface retaining structure may attach to the second tie 3306 at a point at or near the connector 3307. In some forms, one patient interface retaining structure may attach to the second tie 3306 at a point at or near the connector 3307 and another patient interface retaining structure may attach to the second tie 3306 at a point at or near the third tie 3308. In some forms, the second tie 3306, the connector 3307, the third tie 3308, and/or any point intermediate these entities may each independently comprise a magnet in order to correspondingly be attracted to a magnetic retaining feature 8004*b* on second panel portion 6036.

In some forms, the packaging 6000 may be manufactured with the patient interface retaining features 8004*a* and 8004*b* substantially flush with the remainder of the surface of the respective panel. As illustrated in FIG. 4C, the patient interface retaining features 8004*a* and 8004*b* may be pulled away from the surface and leave a space 8009 in the surface that corresponds to the shape of the respective retaining feature 8004*a*, 8004*b*. The space 8009 may be a cut-out or depression in the surface of the respective panel in the shape of the respective retaining feature 8004*a*, 8004*b*.

In certain forms, an outer surface 8008 of the patient interface retaining features 8004*a*, 8004*b* and/or the surface of space 8009 formed in the surface of the respective panel may be backed with an adhesive or other connecting material (e.g., hook and loop material, a magnet, a mechanical fastener, etc.). For example, the outer surface 8008 and the space 8009 may face one another (see e.g., FIG. 8G). When the retaining feature 8004*a* is decoupled from the retaining feature 8004*b*, the retaining feature 8004*a* may move toward the space 8009 in the layer 8002*a* so that the connecting material can retain the retaining feature 8004*a* relative to the respective panel. The same description may also be applicable for the retaining feature 8004*b* relative to the space 8009 in the layer 8002*b*. The use of the connecting material may allow the patient interface retaining features 8004*a* and 8004*b* to return to their substantially flush position when not in use (e.g., forming a more compact appearance). The connecting materials may also allow for repeated connection and disconnection between the outer surface 8008 and the space 8009 so that the retaining features 8004*a*, 8004*b* may be stored while not in use and connected to one another when in use.

In some forms, prior to the first use, the patient interface retaining features 8004*a* and 8004*b* may be outlined at least partially with perforations, which may indicate to the patient where the patient interface retaining features 8004*a* and 8004*b* are located.

In some forms, each patient interface retaining feature 8004*a* may connect to a patient interface retaining structure 8004*b* located on a separate panel of the packaging 6000. The panels including the corresponding patient interface retaining features 8004*a* and 8004*b* may be adjacent to one another and separated by a fold.

In some forms (not shown), a single panel may include both of the patient interface retaining features 8004*a*, 8004*b*. In other words, the connecting pair of patient interface retaining features 8004*a*, 8004*b* may be included on the same panel instead of adjacent panels, as illustrated in FIG. 4C.

An opening sequence of the packaging 6000 is depicted in FIGS. 5A to 5C. As shown in FIG. 5A the user grips the external surfaces of the lid 6020 of packaging 6000, for example at the end flap 6024 and first panel portion 6021.

Next, as shown in FIG. 5B, the lid 6020 is pulled away from the first end wall defined by first end panel portion 6034 of the first end panel 6004*a*. The illustrated example shows the lid 6020 moved in the first direction 6035 (e.g., counter clockwise as illustrated). This movement of the lid 6020 releases the first end panel 6004*a* to allow it to begin to collapse outwardly. In the illustrated example, the first end panel 6004*a* moves in a second direction 6037 (e.g., clockwise as illustrated) that is generally opposite from the first direction 6035. For example, the first end panel 6004*a* may be biased toward a collapsed position (e.g., where the first end panel portion 6034 moves toward being co-planar or is co-planar with the second panel portion 6036, like in FIG. 4B) and may move toward the collapsed position when no longer restrained by the lid 6020. In the depicted example, as a clearance is provided between the patient interface 3000 and the first end panel portion 6034, the patient interface 3000 does not apply any force to the first end panel portion 6034, but it will be appreciated that in other examples, the patient interface 3000 may urge the first end panel portion 6034 outwardly to encourage the collapse.

In the intermediate position shown in FIG. 5B, the side flaps 6026 of the lid 6020 remain partially in contact with the side panels 6006. When the lid 6020 is fully removed as shown in FIG. 5C, the side panels 6006 are released and may begin to collapse outwardly. The side panels 6006 may be biased toward a collapsed position (e.g., where the side panels 6006 move toward being co-planar or are co-planar with the second panel portion 6036, like in FIG. 4B) and may move toward the collapsed position when no longer restrained by the lid 6020. The collapse may also be aided by the weight of the straps 3302 and/or the first and second ties 3304, 3306 of the patient interface 3000, which may contact the internal surfaces of side panels 6006 to urge them outwardly. Where the straps 3302 comprise rigidizers 3316, if the rigidizers 3316 are resilient along at least part of their length, they may be stored under tension in the packaging 6000 and spring outwardly to contact side panels 6006. Further, when the lid 6020 is fully opened, the weight of the posterior part of the patient interface 3000 (including the third tie 3308 and portions of the first and second ties 3304, 3306) may act to urge the second end panel 6004*b* outwardly to encourage it to collapse.

Accordingly, when the lid 6020 is fully opened and panels 6004*a*, 6004*b*, 6006 are fully released, the patient interface 3000 may be displayed in a configuration substantially corresponding to the manner in which it would be worn by a patient in use, as shown in FIG. 4B.

To further assist the patient, one or more internal surfaces of the packaging 6000 may carry printed indicia, which may comprise graphics and/or text that provide instructions for use of the patient interface 3000.

Turning now to FIGS. 6A to 6D and 7A to 7D, another form of the packaging of the present technology is shown.

The packaging 7000 comprises a plurality of panels 7004*a*, 7004*b*, and 7006. The plurality of panels is arranged to be folded inwardly to define a housing for the patient interface 3000.

In this example, the plurality of panels comprises a first end panel 7004*a* and a second end panel 7004*b*, each joined to a bottom wall 7002 at a respective fold 7022*a*, 7022*b*. The plurality of panels also comprises a pair of opposed side panels 7006 that are joined to the bottom wall 7002 at folds 7020.

The first end panel 7004*a* has a pair of side flaps 7008*a* extending from it. A top flap 7009*a* extends from the first end panel 7004*a* and spans between the side flaps 7008*a*. Together, the side flaps 7008*a* and top flap 7009*a* form a first lid portion 7010*a* extending from the first end panel 7004*a*.

In some forms, each side flap 7008*a* may be arranged substantially perpendicularly with respect to the first end panel 7004*a*. In some forms, the top flap 7009*a* may be arranged substantially perpendicularly with respect to the first end panel 7004*a*.

In certain forms, this position may remain regardless of whether the packaging 7000 is in the open position of the closed position.

Similarly, the second end panel 7004*b* has a pair of side flaps 7008*b* extending from it. A top flap 7009*b* extends from the second end panel 7004*b* and spans between the side flaps 7008*b*. Together, the side flaps 7008*b* and top flap 7009*b* form a second lid portion 7010*b* extending from the second end panel 7004*b*.

In some forms, each side flap 7008*b* may be arranged substantially perpendicularly with respect to the second end panel 7004*b*. In some forms, the top flap 7009*b* may be arranged substantially perpendicularly with respect to the second end panel 7004*b*.

In certain forms, this position may remain regardless of whether the packaging 7000 is in the open position or the closed position.

In use, the two lid portions 7010*a*, 7010*b* cooperate with end panels 7004*a*, 7004*b* and side panels 7006 to enclose the patient interface 3000. To do so, side panels 7006 are folded inwardly (towards the bottom wall 7002) about fold lines 7020 to a substantially upright position, and end panels 7004*a* and 7004*b* are then folded inwardly (towards the bottom wall 7002) such that the respective side flaps 7008*a* and 7008*b* pass over the side panels 7006 in their upright position, and the inner edges of top panels 7009*a*, 7009*b* overlap, meet or almost meet so that the top panels 7009*a* and 7009*b* together form a top wall covering a space defined by end panels 7004*a* and 7004*b*, and side panels 7006. The side flaps 7008*a* and 7008*b* act to prevent the side panels 7006 collapsing outwardly while the lid 7010*a*, 7010*b* is in place. A sleeve 7030 (FIG. 7B) may then be fitted over the end panels 7004*a*, 7004*b* to prevent them from collapsing outwardly. Accordingly, the lid 7010*a*, 7010*b* and sleeve 7030 act as panel-retaining structures that enclose and prevent outward collapse of first and second end panels 7004*a*, 7004*b* and side panels 7006.

At least one panel of the packaging 7000 further comprises at least one patient interface retaining feature that is attachable to the patient interface 3000.

For example, as best shown in FIG. 7D, the first end panel 7004*a* may comprise one or more patient interface retaining features 8014 arranged to attach to the patient interface 3000 at or near the plenum chamber 3200. In some examples, the one or more patient interface retaining features 8014 are arranged to attach on either side of the plenum chamber 3200. For example, attachment may be at the concertina portions 3322 on either side, and/or near the connection points 3310 of the straps 3302 to the plenum chamber 3200.

The one or more patient interface retaining features preferably do not contact the seal-forming structure 3100, for hygiene purposes.

In some forms, the one or more patient interface retaining features 8014 are arranged on the first end panel 7004*a* to provide a clearance between the patient interface 3000 and the side flaps 7008*a* when the patient interface 3000 is attached. For example, the one or more patient interface retaining features 8014 may be arranged such that there is a sufficient clearance between the patient interface 3000 and the side flaps 7008*a* to enable the side panels 7006 to fit between the patient interface 3000 and the side flaps 7008*a*.

The one or more patient interface retaining features 8014 may be magnetic and arranged to loop over the patient interface 3000 at or near the plenum chamber 3200. In some examples, retaining feature 8014 comprises a magnet attractable to another magnet on first end panels 7004*a*. Patient interface retaining features 8014 thus secures the patient interface 3000 within the loop formed when the magnets are attracted to each other.

In some forms, each of the side panels 7006 may comprise at least one patient interface retaining structure 8010 arranged to attach to respective sides of the patient interface 3000. For example, the at least one patient interface retaining structure 8010 may attach to the second tie 3306 at a point intermediate the connector 3307 and the plenum chamber 3200. In some forms, the at least one patient interface retaining structure 8010 may attach to the second tie 3306 at a point at or near the connector 3307. In some forms, one patient interface retaining structure 8010 may attach to the second tie 3306 at a point at or near the connector 3307 on one side of the connector 3307 and another patient interface retaining structure 8010 may attach to the second tie 3306 at a point at or near the connector 3307 on the other side of the connector 3307. In some forms, each of the side panels 7006 may comprise at least one magnetic patient interface retaining structure 8010 arranged to attach to respective sides of the patient interface 3000. The respective sides of the patient interface 3000 may comprise a magnet with unlike poles facing the magnetic patient interface retaining structure 8010. For example, the second tie 3306, the connector 3307, and/or any point intermediate these entities may each independently comprise a magnet in order to correspondingly be attracted to a magnetic retaining feature 8014 on each of the side panels 7006.

In some forms, the patient interface retaining structure 8010 may be formed from a separate material than the panels (e.g., the side panels 7006). The patient interface retaining structure 8010 may be connected (e.g., using an adhesive, stitching, mechanical connectors, etc.) to the panels. The patient interface retaining structure 8010 could be constructed from a textile, although other materials may also be used.

In some forms, the second end panel 7004*b* may comprise one or more patient interface retaining features 8012 arranged to attach to the patient interface 3000 at or near the third tie 3308. In some examples, the one or more patient interface retaining features 8012 are arranged to attach on either side of the third tie 3308. For example, attachment may be to the second tie 3306 on either side of the third tie 3308, as shown in FIG. 7D. In some forms, the second end panel 7004*b* may comprise at least one magnetic patient interface retaining feature 8012 arranged to attach to respective sides of the patient interface 3000. The respective sides of the patient interface 3000 may comprise a magnet with unlike poles facing the magnetic patient interface retaining feature 8012. For example, the third tie 3308 or any point intermediate the third tie 3308 may comprise a magnet in order to correspondingly be attracted to a magnetic retaining feature 8012 on the second end panel 7004*b*.

In some forms, the one or more patient interface retaining features 8012 are arranged on the second end panel 7004*b* to provide a clearance 7042 between the patient interface 3000 and the side flaps 7008*b* when the patient interface 3000 is attached. For example, the one or more patient interface retaining features 8012 may be arranged such that there is a sufficient clearance 7042 between the patient interface 3000 and the side flaps 7008*b*, such that when the lid portion 7010*b* is closed over the side panels 7006, the side panels 7006 may fit in the clearance region 7042 so that the patient interface 3000 does not interfere with the closing of the lid portion 7010*b*.

An opening sequence of the packaging 7000 is depicted in FIGS. 7A to 7D. As shown in FIG. 7A the user grips the sleeve 7030 of packaging 7000, and as shown in FIG. 7B, starts to pull it away to begin to expose the lid portions 7010*a*, 7010*b*.

In some forms, the user may first apply a force to one of the side panels 7006 (or another panel depending on the orientation of the sleeve 7030). This force is illustrated by the arrow 7100 in FIG. 7A. The force 7100 may create relative movement between the sleeve 7030 and the remainder of the packaging 7000. In other words, the force 7100 may move the packaging toward the orientation of FIG. 7B where at least part of the lid portions 7010*a*, 7010*b* is exposed.

Once the lid portions 7010*a*, 7010*b* (or part thereof) are exposed, the user may continue to apply forces in order to separate the sleeve 7030 and fully expose the packaging 7000. For example, the user may grasp the sleeve 7030 and pull in a direction 7104. This direction 7104 may be oriented opposite the direction of force 7100 in order to further expose the lid portions 7010*a*, 7010*b*. Additionally, the use may pull the packaging 7000 in a direction 7108, which may be opposite to the direction 7104. Pulling the sleeve 7030 and packaging 7000 separately and in opposite direction may assist in fully exposing the lid portions 7010*a*, 7010*b*.

Next, as shown in FIG. 7C, the sleeve 7030 is completely removed from the packaging 7000. This releases the lid portions 7010*a*, 7010*b*, and thus the end panels 7004*a* and 7004*b* to which they are attached, to allow them to collapse outwardly. For example, the lid portions 7010*a*, 7010*b* may move in opposite direction while moving toward the open position. As illustrated, lid portion 7010*a* may move in a generally counter-clockwise direction "A" and the lid portion 7010*b* may move in a generally clockwise direction "B". The weight of the components of the patient interface 3000 that are attached to the respective end panels 7004*a* and 7004*b* tends to urge the end panels 7004*a*, 7004*b* outwardly (away from the bottom wall 7002) to encourage the collapse.

Finally, as shown in FIG. 7D, after the end panels 7004*a*, 7004*b* collapse and the side flaps 7008*a*, 7008*b* are clear of the side panels 7006, the side panels 7006 also collapse under the weight of the straps 3302 and/or the first and second ties 3304, 3306 to which the side panels 7006 are attached. The collapse may be aided by rigidizers 3316, since as before, if the rigidizers 3316 are resilient along at least part of their length, they may be stored under tension in the packaging 6000 and spring outwardly to contact side panels 7006.

Accordingly, when the lid 7010*a*, 7010*b* is fully opened and panels 7004*a*, 7004*b*, 7006 are fully released, the patient interface 3000 may be displayed in a configuration substantially corresponding to the manner in which it would be worn by a patient in use, as shown in FIG. 4B.

Several non-limiting examples of patient interface retaining structures are shown in FIGS. 8A to 8G.

In the examples of FIGS. 8A, 8F, and 8G, a patient interface retaining structure 8004 may comprise a strip or band of material, such as cardboard, that is looped over part of the patient interface and secured to itself, or to another part of the packaging, such as a bottom wall of the packaging or to a layer of material 8002 that is attached to the bottom wall. The strip or band may be secured by any suitable means, such as adhesive, tape, and the like.

For example, in FIG. 8A, each of the opposed ends of a strip of material 8004 may be inserted into a hole in the layer 8002. In another example shown in FIG. 8F, one end of strap 8004 may be affixed to a surface of the layer 8002, and the other (free) end may be inserted into a hole 8003 in the layer 8002.

In some examples, as shown in FIG. 8G, the strip of material may be a cut-out portion of, or otherwise extend from, the layer 8002 (e.g., this may be similar to the illustration of FIG. 4C). For example, a strip 8004*a* that is cut out from region 8002*a* may be looped over a part of the patient interface 3000 and then secured to a surface of the layer 8002. In other examples, a strip 8004*a* cut out from region 8002*a* may connect with a second strip 8004*b* cut out from another region 8002*b* of the layer 8002. In some forms, a head portion of the first strip 8004*a* may have a shape that complements a head portion of the second strip 8004*b* so that the head portions interlock to secure the patient interface 3000 to the packaging.

An arrangement such as that shown in FIGS. 8A, 8F, and 8G may be useful where the packaging is designed to be disposable and is preferred to be recyclable.

In the example of FIG. 8B, the patient interface retaining feature 8012 comprises a fabric or ribbon 8020 that is wrapped around a button 8022. One end of the ribbon 8020 may be secured to the packaging (for example, end panel 7004*b*), and the button 8022 may also be secured to the packaging, such that the other end of the ribbon may be wrapped around it.

In the example of FIG. 8C, the patient interface retaining feature 8014 comprises an elastic band 8030 that has an aperture at a free end to receive a button 8032. The elastic band 8030 may be constructed from any material that provides resilient extensibility. One end of the elastic band 8030 may be secured to the packaging (for example, end panel 7004*a*), and the button 8032 may also be secured to the packaging, such that the free end of the elastic band 8030 may be secured to the button 8032. In this example, the button 8032 may be considered a male part that is selectively receivable in an opening of the elastic band 8030 (e.g., the female part).

In the example of FIG. 8D and FIG. 8E, the patient interface retaining structure 8010 comprises an elastic band that has a first end 8040 that is secured to the packaging, such as to the side panel 7006, and a second, free, end 8042 that carries a male part 8044 of a press stud. A female part 8046 of the press stud is secured to the packaging, such that the free end 8042 of the elastic band may be stretched over part of the patient interface and the male part 8044 may be pressed into the female part 8046 to secure the patient interface. It will be appreciated that male and female parts may be switched.

As mentioned above, the patient interface retaining feature may be magnetic. The magnetic patient interface retaining feature may have a first end that is secured to the packaging, and a second, free, end that carries a magnet. The magnetic patient interface retaining feature be attracted to another magnetic patient interface retaining feature having opposite poles in order to secure the patient interface within the loop that is formed. Alternatively, the magnetic patient interface retaining feature may be attracted to another magnet on the first, second and/or side panels of the packaging in order to secure the patient interface within the loop that is formed. Alternatively, the magnetic patient interface retaining feature may be attracted to another magnet on the patient interface in order to secure the patient interface.

For example, the male and female parts 8044, 8046 in FIG. 8D may connect to one another using a magnetic attraction instead of and/or in addition to the mechanical interaction described above.

It was found that the retaining features (and especially the magnetic retaining features) better secure the patient interface in the packaging so that squeezing of the patient interface may be avoided. The retaining features act as holding features in the packaging, so that the patient interface is presented in a fixed position when the packaging is opened. This may additionally be paired with instructions in the packaging to help first time users understand how to wear the patient interface. If the patient interface has some rigidity, the retaining features may further facilitate the display of the patient interface when the packaging is opened.

Any combination of the patient interface retaining features in FIGS. 8A to 8G and the magnetic patient interface retaining features may be used with packaging 6000 or packaging 7000.

A further form of the packaging will now be described with reference to FIGS. 9A-9D. As best shown in the open view of FIG. 9C, packaging 9000 comprises a plurality of panels 9004*a*, 9004*b*, 9006. The plurality of panels is arranged to be folded inwardly to define a housing for a patient interface 3000 (FIG. 9B).

In this example, the plurality of panels comprises a first end panel 9004*a* and a second end panel 9004*b* opposite the first end panel 9004*a*. The first and second end panels 9004*a*, 9004*b* are each connected to a bottom panel 9002 that defines a bottom wall of the packaging. Each of the first and second end panels 9004*a*, 9004*b* is inwardly foldable (i.e. towards bottom panel 9002) to a generally upright position to form respective end walls of a housing for the patient interface 3000.

The plurality of panels also comprises a top panel 9010 extending from the second end panel 9004*b*. The top panel 9010 is inwardly foldable to form a lid for the packaging 9000.

The plurality of panels further comprises a pair of opposed side panels 9006. Each side panel 9006 is inwardly foldable (i.e., towards bottom panel 9002) to a generally upright position to form a side wall of the housing for the patient interface 3000.

The top panel 9010 comprises one or more panel retaining structures for preventing outward collapse of the side panels 9006 and first end panel 9004*a*. For example, the top panel 9010 may comprise an end flap 9024 extending generally perpendicular to the top panel 9010. The end flap 9024 may engage with an external surface of the first end panel 9004*a*. The end flap 9024 acts as a panel-retaining structure to prevent outward collapse of the first end panel 9004*a*.

The top panel 9010 may also comprise a pair of opposed side flaps 9026 that extend mutually perpendicularly to the top panel 9010 and the end flap 9024. The side flaps 9026 may be connected to both the top panel 9010 and the end flap 9024. Accordingly, when side panels 9006, first end panel 9004*a* and second end panel 9004*b* are all folded inwardly, each side flap 9026 of the top panel 9010 may be arranged to engage with respective external surfaces of the side panels 9006 in their upright position, and thus act as part of a panel-retaining structure that also comprises the end flap 9024.

In some forms, the top panel 9010 may comprise one or more magnetic connectors that releasably fasten the top panel 9010 to the side panels 9006 and first end panel 9004*a*. For example, first end panel 9004*a* and side panels 9006 may each comprise first magnetic portions (e.g. located at a flattened top portion of the first end panel 9004*a* and side panels 9006) that magnetically attach to corresponding second magnetic portions on the top panel 9010.

At least one panel of the packaging 9000 further comprises at least one patient interface retaining feature (as mentioned above) that is attachable to the patient interface 3000. For example, a hook 9030 or other member (such as a clip, catch, or hook-and-loop fastener) suitable for attachment to an upper portion of the patient interface, such as at a position along crown strap 3303, may be provided on a lower surface of the top panel 9010.

In some forms, the hook 9030 may be constructed from a different material than the top panel 9010. For example, the hook 9030 may be constructed from a more rigid material than the top panel 9010.

As illustrated in FIG. 9D, the hook 9030 may be positioned on an interior surface of the top panel 9010. The hook 9030 may hang directly over the bottom panel 9002.

In some forms, the hook 9030 may have a substantially angular shape. For example, FIG. 9D illustrates that the hook 9030 includes a plurality of segments that are formed at angles with respect to one another. These angles may be right angles, although other angles are also contemplated.

In other forms, the hook 9030 may be at least partially smooth. For example, the hook 9030 may be at least partially curved between its free end and fixed end.

In some forms, at least one of the side panels 9006, first end panel 9004*a* and second end panel 9004*b* may also comprise a patient interface retaining feature, such as any of the features shown in FIGS. 8A to 8G.

The top panel 9010 may further comprise a tab or other grippable member 9020 projecting from its external surface to enable a user to pick up the packaging without holding the sides of the packaging 9000. In some forms of the present technology, this causes the one or more panel-retaining structures to release due to the weight of the patient interface 3000, to thereby cause the side panels 9006 and first end panel 9004*a* to collapse.

In some forms, the top panel 9010 may be hinged at an intermediate section thereof to define a first top panel portion 9010*a* and a second top panel portion 9010*b* such that picking up the packaging 9000 by the tab 9020 causes the top panel 9010 to collapse outwardly (away from bottom panel 9002) as the panels 9006 and 9004*a* are released from the top panel 9010 under the weight of the patient interface 3000.

The packaging 6000, 7000, 9000 may be partially or completely formed from cardboard. In some examples, the packaging may be formed from two or more layers of cardboard of different types. For example, an outer layer of the packaging may be 300 gsm solid fibreboard and an inner layer may be corrugated E flute cardboard having a thickness of 1.5 mm.

5.5 RPT DEVICE

An RPT device 4000 in accordance with one aspect of the present technology comprises mechanical, pneumatic, and/or electrical components and is configured to execute one or more algorithms, such as any of the methods, in whole or in part, described herein. The RPT device 4000 may be configured to generate a flow of air for delivery to a patient's airways, such as to treat one or more of the respiratory conditions described elsewhere in the present document.

5.6 AIR CIRCUIT

An air circuit 4170 in accordance with an aspect of the present technology is a conduit or a tube constructed and arranged to allow, in use, a flow of air to travel between two components such as RPT device 4000 and the patient interface 3000.

5.7 HUMIDIFIER

5.7.1 Humidifier Overview

In one form of the present technology there is provided a humidifier 5000 to change the absolute humidity of air or gas for delivery to a patient relative to ambient air. Typically, the humidifier 5000 is used to increase the absolute humidity and increase the temperature of the flow of air (relative to ambient air) before delivery to the patient's airways.

5.8 GLOSSARY

For the purposes of the present technology disclosure, in certain forms of the present technology, one or more of the following definitions may apply. In other forms of the present technology, alternative definitions may apply.

5.8.1 General

Air: In certain forms of the present technology, air may be taken to mean atmospheric air, and in other forms of the present technology air may be taken to mean some other combination of breathable gases, e.g. oxygen enriched air.

Ambient: In certain forms of the present technology, the term ambient will be taken to mean (i) external of the treatment system or patient, and (ii) immediately surrounding the treatment system or patient.

For example, ambient humidity with respect to a humidifier may be the humidity of air immediately surrounding the humidifier, e.g. the humidity in the room where a patient is sleeping. Such ambient humidity may be different to the humidity outside the room where a patient is sleeping.

In another example, ambient pressure may be the pressure immediately surrounding or external to the body.

In certain forms, ambient (e.g., acoustic) noise may be considered to be the background noise level in the room where a patient is located, other than for example, noise generated by an RPT device or emanating from a mask or patient interface. Ambient noise may be generated by sources outside the room.

Automatic Positive Airway Pressure (APAP) therapy: CPAP therapy in which the treatment pressure is automatically adjustable, e.g. from breath to breath, between minimum and maximum limits, depending on the presence or absence of indications of SDB events.

Continuous Positive Airway Pressure (CPAP) therapy: Respiratory pressure therapy in which the treatment pressure is approximately constant through a respiratory cycle of a patient. In some forms, the pressure at the entrance to the airways will be slightly higher during exhalation, and slightly lower during inhalation. In some forms, the pressure will vary between different respiratory cycles of the patient, for example, being increased in response to detection of indications of partial upper airway obstruction, and decreased in the absence of indications of partial upper airway obstruction.

Flow rate: The volume (or mass) of air delivered per unit time. Flow rate may refer to an instantaneous quantity. In some cases, a reference to flow rate will be a reference to a scalar quantity, namely a quantity having magnitude only. In other cases, a reference to flow rate will be a reference to a vector quantity, namely a quantity having both magnitude and direction. Flow rate may be given the symbol Q. 'Flow rate' is sometimes shortened to simply 'flow' or 'airflow'.

In the example of patient respiration, a flow rate may be nominally positive for the inspiratory portion of a breathing cycle of a patient, and hence negative for the expiratory portion of the breathing cycle of a patient. Device flow rate, Qd, is the flow rate of air leaving the RPT device. Total flow rate, Qt, is the flow rate of air and any supplementary gas reaching the patient interface via the air circuit. Vent flow rate, Qv, is the flow rate of air leaving a vent to allow washout of exhaled gases. Leak flow rate, Ql, is the flow rate of leak from a patient interface system or elsewhere. Respiratory flow rate, Qr, is the flow rate of air that is received into the patient's respiratory system.

Flow therapy: Respiratory therapy comprising the delivery of a flow of air to an entrance to the airways at a controlled flow rate referred to as the treatment flow rate that is typically positive throughout the patient's breathing cycle.

Humidifier: The word humidifier will be taken to mean a humidifying apparatus constructed and arranged, or configured with a physical structure to be capable of providing a therapeutically beneficial amount of water ($H_2O$) vapour to a flow of air to ameliorate a medical respiratory condition of a patient.

Leak: The word leak will be taken to be an unintended flow of air. In one example, leak may occur as the result of an incomplete seal between a mask and a patient's face. In another example leak may occur in a swivel elbow to the ambient.

Noise, conducted (acoustic): Conducted noise in the present document refers to noise which is carried to the patient by the pneumatic path, such as the air circuit and the patient interface as well as the air therein. In one form, conducted noise may be quantified by measuring sound pressure levels at the end of an air circuit.

Noise, radiated (acoustic): Radiated noise in the present document refers to noise which is carried to the patient by the ambient air. In one form, radiated noise may be quantified by measuring sound power/pressure levels of the object in question according to ISO 3744.

Noise, vent (acoustic): Vent noise in the present document refers to noise which is generated by the flow of air through any vents such as vent holes of the patient interface.

Oxygen enriched air: Air with a concentration of oxygen greater than that of atmospheric air (21%), for example at least about 50% oxygen, at least about 60% oxygen, at least about 70% oxygen, at least about 80% oxygen, at least about 90% oxygen, at least about 95% oxygen, at least about 98% oxygen, or at least about 99% oxygen. "Oxygen enriched air" is sometimes shortened to "oxygen".

Medical Oxygen: Medical oxygen is defined as oxygen enriched air with an oxygen concentration of 80% or greater.

Patient: A person, whether or not they are suffering from a respiratory condition.

Pressure: Force per unit area. Pressure may be expressed in a range of units, including $cmH_2O$, g-f/cm2 and hectopascal. 1 $cmH_2O$ is equal to 1 g-f/cm2 and is approximately 0.98 hectopascal (1 hectopascal=100 Pa=100 $N/m^2$=1 millibar~ 0.001 atm). In this specification, unless otherwise stated, pressure is given in units of $cmH_2O$.

The pressure in the patient interface is given the symbol Pm, while the treatment pressure, which represents a target value to be achieved by the interface pressure Pm at the current instant of time, is given the symbol Pt.

Respiratory Pressure Therapy: The application of a supply of air to an entrance to the airways at a treatment pressure that is typically positive with respect to atmosphere.

Ventilator: A mechanical device that provides pressure support to a patient to perform some or all of the work of breathing.

5.8.1.1 Materials

Silicone or Silicone Elastomer: A synthetic rubber. In this specification, a reference to silicone is a reference to liquid silicone rubber (LSR) or a compression moulded silicone rubber (CMSR). One form of commercially available LSR is SILASTIC (included in the range of products sold under this trademark), manufactured by Dow Corning. Another manufacturer of LSR is Wacker. Unless otherwise specified to the contrary, an exemplary form of LSR has a Shore A (or Type A) indentation hardness in the range of about 35 to about 45 as measured using ASTM D2240

Polycarbonate: a thermoplastic polymer of Bisphenol-A Carbonate.

5.8.1.2 Mechanical Properties

Resilience: Ability of a material to absorb energy when deformed elastically and to release the energy upon unloading.

Resilient: Will release substantially all of the energy when unloaded. Includes e.g. certain silicones, and thermoplastic elastomers.

Hardness: The ability of a material per se to resist deformation (e.g. described by a Young's Modulus, or an indentation hardness scale measured on a standardised sample size).

- 'Soft' materials may include silicone or thermo-plastic elastomer (TPE), and may, e.g. readily deform under finger pressure.
- 'Hard' materials may include polycarbonate, polypropylene, steel or aluminium, and may not e.g. readily deform under finger pressure.

Stiffness (or rigidity) of a structure or component: The ability of the structure or component to resist deformation in response to an applied load. The load may be a force or a moment, e.g. compression, tension, bending or torsion. The structure or component may offer different resistances in different directions. The inverse of stiffness is flexibility.

Floppy structure or component: A structure or component that will change shape, e.g. bend, when caused to support its own weight, within a relatively short period of time such as 1 second.

Rigid structure or component: A structure or component that will not substantially change shape when subject to the loads typically encountered in use. An example of such a use may be setting up and maintaining a patient interface in sealing relationship with an entrance to a patient's airways, e.g. at a load of approximately 20 to 30 cmH2O pressure.

As an example, an I-beam may comprise a different bending stiffness (resistance to a bending load) in a first direction in comparison to a second, orthogonal direction. In another example, a structure or component may be floppy in a first direction and rigid in a second direction.

5.8.2 Patient Interface

Anti-asphyxia valve (AAV): The component or sub-assembly of a mask system that, by opening to atmosphere in a failsafe manner, reduces the risk of excessive CO2 rebreathing by a patient.

Elbow: An elbow is an example of a structure that directs an axis of flow of air travelling therethrough to change direction through an angle. In one form, the angle may be approximately 90 degrees. In another form, the angle may be more, or less than 90 degrees. The elbow may have an approximately circular cross-section. In another form the elbow may have an oval or a rectangular cross-section. In certain forms an elbow may be rotatable with respect to a mating component, e.g. about 360 degrees. In certain forms an elbow may be removable from a mating component, e.g. via a snap connection. In certain forms, an elbow may be assembled to a mating component via a one-time snap during manufacture, but not removable by a patient.

Frame: Frame will be taken to mean a mask structure that bears the load of tension between two or more points of connection with a headgear. A mask frame may be a non-airtight load bearing structure in the mask. However, some forms of mask frame may also be air-tight.

Headgear: Headgear will be taken to mean a form of positioning and stabilizing structure designed for use on a head. For example the headgear may comprise a collection of one or more struts, ties and stiffeners configured to locate and retain a patient interface in position on a patient's face for delivery of respiratory therapy. Some ties are formed of a soft, flexible, elastic material such as a laminated composite of foam and fabric.

Membrane: Membrane will be taken to mean a typically thin element that has, preferably, substantially no resistance to bending, but has resistance to being stretched.

Plenum chamber: a mask plenum chamber will be taken to mean a portion of a patient interface having walls at least partially enclosing a volume of space, the volume having air therein pressurised above atmospheric pressure in use. A shell may form part of the walls of a mask plenum chamber.

Seal: May be a noun form ("a seal") which refers to a structure, or a verb form ("to seal") which refers to the effect. Two elements may be constructed and/or arranged to 'seal' or to effect 'sealing' therebetween without requiring a separate 'seal' element per se.

Shell: A shell will be taken to mean a curved, relatively thin structure having bending, tensile and compressive stiffness. For example, a curved structural wall of a mask may be a shell. In some forms, a shell may be faceted. In some forms a shell may be airtight. In some forms a shell may not be airtight.

Stiffener: A stiffener will be taken to mean a structural component designed to increase the bending resistance of another component in at least one direction.

Strut: A strut will be taken to be a structural component designed to increase the compression resistance of another component in at least one direction.

Swivel (noun): A subassembly of components configured to rotate about a common axis, preferably independently, preferably under low torque. In one form, the swivel may be constructed to rotate through an angle of at least 360 degrees. In another form, the swivel may be constructed to rotate through an angle less than 360 degrees. When used in the context of an air delivery conduit, the sub-assembly of components preferably comprises a matched pair of cylindrical conduits. There may be little or no leak flow of air from the swivel in use.

Tie (noun): A structure designed to resist tension.

Vent: (noun): A structure that allows a flow of air from an interior of the mask, or conduit, to ambient air for clinically effective washout of exhaled gases. For example, a clinically effective washout may involve a flow rate of about 10 litres per minute to about 100 litres per minute, depending on the mask design and treatment pressure.

5.9 OTHER REMARKS

A portion of the disclosure of this patent document contains material which is subject to copyright protection.

The copyright owner has no objection to the facsimile reproduction by anyone of the patent document or the patent disclosure, as it appears in Patent Office patent files or records, but otherwise reserves all copyright rights whatsoever.

Unless the context clearly dictates otherwise and where a range of values is provided, it is understood that each intervening value, to the tenth of the unit of the lower limit, between the upper and lower limit of that range, and any other stated or intervening value in that stated range is encompassed within the technology. The upper and lower limits of these intervening ranges, which may be independently included in the intervening ranges, are also encompassed within the technology, subject to any specifically excluded limit in the stated range. Where the stated range includes one or both of the limits, ranges excluding either or both of those included limits are also included in the technology.

Furthermore, where a value or values are stated herein as being implemented as part of the technology, it is understood that such values may be approximated, unless otherwise stated, and such values may be utilized to any suitable significant digit to the extent that a practical technical implementation may permit or require it.

Unless defined otherwise, all technical and scientific terms used herein have the same meaning as commonly understood by one of ordinary skill in the art to which this technology belongs. Although any methods and materials similar or equivalent to those described herein may also be used in the practice or testing of the present technology, a limited number of the exemplary methods and materials are described herein.

When a particular material is identified as being used to construct a component, obvious alternative materials with similar properties may be used as a substitute. Furthermore, unless specified to the contrary, any and all components herein described are understood to be capable of being manufactured and, as such, may be manufactured together or separately.

It must be noted that as used herein and in the appended claims, the singular forms "a", "an", and "the" include their plural equivalents, unless the context clearly dictates otherwise.

All publications mentioned herein are incorporated herein by reference in their entirety to disclose and describe the methods and/or materials which are the subject of those publications. The publications discussed herein are provided solely for their disclosure prior to the filing date of the present application. Nothing herein is to be construed as an admission that the present technology is not entitled to antedate such publication by virtue of prior invention. Further, the dates of publication provided may be different from the actual publication dates, which may need to be independently confirmed.

The terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The subject headings used in the detailed description are included only for the ease of reference of the reader and should not be used to limit the subject matter found throughout the disclosure or the claims. The subject headings should not be used in construing the scope of the claims or the claim limitations.

Although the technology herein has been described with reference to particular examples, it is to be understood that these examples are merely illustrative of the principles and applications of the technology. In some instances, the terminology and symbols may imply specific details that are not required to practice the technology. For example, although the terms "first" and "second" may be used, unless otherwise specified, they are not intended to indicate any order but may be utilised to distinguish between distinct elements. Furthermore, although process steps in the methodologies may be described or illustrated in an order, such an ordering is not required. Those skilled in the art will recognize that such ordering may be modified and/or aspects thereof may be conducted concurrently or even synchronously.

It is therefore to be understood that numerous modifications may be made to the illustrative examples and that other arrangements may be devised without departing from the spirit and scope of the technology.

The invention claimed is:

1. Packaging for a patient interface comprising a seal-forming structure with at least a nasal region, wherein the seal forming structure is coupled to a positioning and stabilising structure with at least a first tie for holding the seal-forming structure in a therapeutically effective position on a patient's head, the packaging comprising:

a plurality of panels arranged to be folded inwardly to define a housing for the patient interface, the plurality of panels comprising a pair of opposed side panels and a pair of opposed end panels; and a panel retainer that is configured to prevent outward collapse of the panels whilst the patient interface is held in a compressed state;

wherein at least one of the panels comprises at least one patient interface retainer configured to removably attach to the patient interface; and wherein the panel retainer is configured to be released in order to cause the one or more panels to collapse outwardly and to allow the patient interface in the compressed state to urge one or more of the panels to collapse outwardly, to thereby enable display of the patient interface in a substantially in-use configuration.

2. Packaging according to claim 1, wherein the panel retainer comprises a lid having at least one flap arranged to engage an external surface of a first end panel of the pair of opposed end panels.

3. Packaging according to claim 2, wherein the lid at least one of, extends from, and comprises at least part of, a second end panel of the pair of opposed end panels.

4. Packaging according to claim 3, wherein the lid has a hinge that is connected to, or is part of, the second end panel.

5. Packaging according to claim 4, wherein part of the second end panel forms a top wall of the lid.

6. Packaging according to claim 2, wherein the lid comprises first and second lid portions each comprising a pair of opposed side flaps arranged to engage with respective side panels; and wherein the panel retainer comprises the opposed side flaps of the first and second lid portions.

7. Packaging according to claim 6, wherein each lid portion comprises a top wall extending transversely of its opposed side flaps and a respective one of the end panels.

8. Packaging according to claim 6, wherein the panel retainer comprises a sleeve arranged to fit over the first and second lid portions.

9. Packaging according to claim 1, wherein the panels are joined by a foldable web.

10. Packaging according to claim 1, wherein the at least one patient interface retainer comprises one or more of: a tie; a clip; a press stud; a strap; a hook and loop fastener; a button; and a magnet.

11. Packaging according to claim 10, wherein the at least one patient interface retainer comprises a strap, and wherein the strap is formed from a cut-out portion of a layer of material that is laminated to one of the panels.

12. Packaging according to claim 10, wherein when the at least one patient interface retainer comprises a magnet, one of the end panels comprises at least two patient interface retainers arranged to be magnetically attractable to each other.

13. Packaging according to claim 10, wherein the at least one patient interface retainer comprises a magnet for attracting to a magnet on the patient interface.

14. Packaging according to claim 1, wherein the plurality of panels further comprises a top panel extending from one of said end panels, the top panel being arranged to fold to close the packaging.

15. Packaging according to claim 14, wherein the top panel comprises the panel retainer.

16. Packaging according to claim 14, wherein the top panel comprises one or more patient interface retainers arranged to attach to the patient interface at a crown region of the positioning and stabilising structure.

17. Packaging according to claim 16, wherein the one or more patient interface retainers of the top panel comprise one or more hooks.

18. Packaging according to claim 17, wherein on release of the panel retainer, the side panels and the other of said end panels is collapsible under gravity to display the patient interface in a hanging position.

19. Packaging according to claim 1, wherein one or more internal surfaces of the panels carries printed indicia.

20. Packaging according to claim 19, wherein the printed indicia comprise instructions for use of the patient interface.

21. A packaging system comprising:

a patient interface; and the packaging of claim 1.

22. Packaging for a patient interface comprising a seal-forming structure with at least a nasal region, wherein the seal forming structure is coupled to a positioning and stabilising structure with at least a first tie for holding the seal-forming structure in a therapeutically effective position on a patient's head, the packaging comprising:

a plurality of panels arranged to be folded inwardly to define a housing for the patient interface, the plurality of panels comprising a pair of opposed side panels and a pair of opposed end panels; and a panel retainer that is arranged to prevent outward collapse of the panels such that the patient interface is held in a compressed state;

wherein at least one of the panels comprises at least one patient interface retainer configured to removably attach to the patient interface; and wherein the panel retainer is releasable to cause the patient interface in the compressed state to urge one or more of the panels outwardly, to thereby enable display of the patient interface in a substantially in-use configuration, and wherein one of the end panels comprises at least two patient interface retainers arranged to attach to the patient interface on either side of the seal-forming structure, or at opposed ends of a posterior strap of the positioning and stabilising structure.

23. Packaging for a patient interface comprising a seal-forming structure with at least a nasal region, wherein the seal forming structure is coupled to a positioning and stabilising structure with at least a first tie for holding the seal-forming structure in a therapeutically effective position on a patient's head, the packaging comprising:

a plurality of panels arranged to be folded inwardly to define a housing for the patient interface, the plurality of panels comprising a pair of opposed side panels and a pair of opposed end panels; and a panel retainer that is arranged to prevent outward collapse of the panels such that the patient interface is held in a compressed state;

wherein at least one of the panels comprises at least one patient interface retainer configured to removably attach to the patient interface; and wherein the panel retainer is releasable to cause the patient interface in the compressed state to urge one or more of the panels outwardly, to thereby enable display of the patient interface in a substantially in-use configuration, and wherein each end panel comprises at least one patient interface retainer, and each patient interface retainer of the end panels is positioned to provide a clearance to accommodate the side panels when the panels are folded inwardly.

* * * * *